US011073012B2

(12) United States Patent
Jones et al.

(10) Patent No.: US 11,073,012 B2
(45) Date of Patent: Jul. 27, 2021

(54) LWD FORMATION TESTER WITH RETRACTABLE LATCH FOR WIRELINE

(71) Applicant: Halliburton Energy Services, Inc., Houston, TX (US)

(72) Inventors: Christopher Michael Jones, Katy, TX (US); Darren George Gascooke, Houston, TX (US); Anthony Herman Van Zuilekom, Houston, TX (US); Glenn Andrew Wilson, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 16/700,591

(22) Filed: Dec. 2, 2019

(65) Prior Publication Data

US 2021/0164342 A1 Jun. 3, 2021

(51) Int. Cl.
*E21B 47/12* (2012.01)
*E21B 49/08* (2006.01)
(Continued)

(52) U.S. Cl.
CPC ..... *E21B 47/12* (2013.01); *E21B 49/082* (2013.01); *E21B 49/088* (2013.01); *E21B 49/10* (2013.01); *E21B 47/01* (2013.01)

(58) Field of Classification Search
CPC ..... E21B 47/12; E21B 49/088; E21B 49/082; E21B 49/10; E21B 49/083; E21B 47/01
See application file for complete search history.

(56) References Cited

U.S. PATENT DOCUMENTS 4,392,377 A 7/1983 Rankin
5,137,086 A * 8/1992 Stokley ..... E21B 49/082 166/191
(Continued)

FOREIGN PATENT DOCUMENTS

CN 101896684 A 11/2010
WO 2012007884 A2 1/2012
WO 2015074243 A1 5/2015

OTHER PUBLICATIONS

Foreign Communication from Related Application—International Search Report and Written Opinion of the International Searching Authority, International Application No. PCT/US2019/065447, dated Aug. 31, 2020, 14 pages.
(Continued)

*Primary Examiner* — Taras P Bemko
*Assistant Examiner* — Yanick A Akaragwe
(74) *Attorney, Agent, or Firm* — Conley Rose, P.C.; Rodney B. Carroll

(57) ABSTRACT

A method including, without removing a BHA from a wellbore of a well extending into a formation, extending, into an interior flow bore of the BHA, a first component of a wet latch assembly to provide an extended first component of the wet latch assembly, conveying downhole via a wireline cable, from a surface through an interior flow bore provided by a drill string, a second component of the wet latch assembly, and coupling the second component of the wet latch assembly with the extended first component of the wet latch assembly such that an electrical connection is established between the first component and the second component and between the BHA and the surface via the wireline cable, and testing the formation with a formation tester of the BHA, while providing power and/or data
(Continued)

*FIG. 1E* telemetry for the formation tester via the wet latch assembly and the wireline cable.

21 Claims, 13 Drawing Sheets

(51) Int. Cl.
*E21B 49/10* (2006.01)
*E21B 47/01* (2012.01)

(56) References Cited

U.S. PATENT DOCUMENTS 5,236,048 A 8/1993 Skinner et al.
6,236,620 B1 5/2001 Schultz et al.
6,776,233 B2 8/2004 Meehan
7,093,674 B2 8/2006 Paluch et al.
7,096,976 B2 8/2006 Paluch et al.
7,163,065 B2 1/2007 Zhang et al.
7,565,936 B2 7/2009 Zhang et al.
7,913,774 B2 3/2011 Partouche
7,997,341 B2 8/2011 Briquet et al.
8,322,433 B2 12/2012 Bedouet et al.
8,573,294 B2 11/2013 Struthers et al.
8,711,655 B2 4/2014 Gzara et al.
8,726,983 B2 5/2014 Khan
8,899,338 B2 12/2014 Elsayed et al.
8,931,548 B2 1/2015 Partouche et al.
9,322,252 B2 4/2016 Head
9,347,277 B2 5/2016 Taherian et al.
9,416,655 B2 8/2016 Partouche et al.
9,458,677 B2 10/2016 Struthers et al.
9,512,697 B2 12/2016 Pike
9,702,212 B2 7/2017 Breda et al.
9,752,385 B2 9/2017 Hay et al.
9,850,710 B2 12/2017 Hay
9,976,371 B2 5/2018 Castillo et al.
9,988,894 B1 6/2018 Malone et al.
2002/0050361 A1 5/2002 Shaw et al.
2003/0010491 A1* 1/2003 Collette ..... E21B 43/128 166/65.1
2003/0085815 A1 5/2003 Tilton et al.
2003/0234120 A1 12/2003 Paluch et al.
2004/0119607 A1 6/2004 Davies et al.
2005/0016769 A1 1/2005 Wallace
2006/0087449 A1 4/2006 Radzinski
2008/0245570 A1 10/2008 Partouche
2009/0049904 A1* 2/2009 Meister ..... E21B 49/10 73/152.23
2009/0158837 A1 6/2009 Meek et al.
2009/0166037 A1 7/2009 Sroka
2010/0018304 A1 1/2010 McGregor
2010/0095758 A1* 4/2010 Georgi ..... E21B 49/084 73/152.28
2011/0016962 A1* 1/2011 DiFoggio ..... G01N 29/036 73/152.15
2011/0114310 A1* 5/2011 Ross ..... E21B 49/10 166/250.17
2011/0127085 A1 6/2011 Partouche
2014/0020907 A1 1/2014 Head
2015/0122478 A1 5/2015 Partouche et al.
2015/0275608 A1 10/2015 Breda et al.
2015/0340803 A1 11/2015 Li et al.
2018/0313196 A1* 11/2018 Frantz, III ..... E21B 47/008
2020/0263506 A1 8/2020 Ash et al.

OTHER PUBLICATIONS

Filing Receipt, Specificaiton and Drawings for U.S. Appl. No. 16/700,598, entitled "LWD Formation Tester with Retractable Latch for Wireline," filed Dec. 2, 2019, 73 pages.
Electronic Acknowledgement Receipt, Specification and Drawings for International Application No. PCT/US2019/065445, entitled "LWD Formation Tester with Retractable Latch for Wireline," filed Dec. 10, 2019, 57 pages.
Electronic Acknowledgement Receipt, Specification and Drawings for International Application No. PCT/US2019/065447 entitled "LWD Formation Tester with Retractable Latch for Wireline," filed Dec. 10, 2019, 58 pages.
Foreign Communication from Related Application—International Search Report and Written Opinion of the International Searching Authority, International Application No. PCT/US2019/065445, dated Aug. 31, 2020, 12 pages.
Pipe Conveyed Logging Flowless Downhole System, Vinci Technologies, Oct. 2, 2018, 4 pages.
Office Action (37 pages), U.S. Appl. No. 16/700,598, filed Dec. 2, 2019.
Notice of Allowance and Fees Due (9 pages), dated Jun. 1, 2019, U.S. Appl. No. 16/700,598, filed Dec. 2, 2019.

* cited by examiner

LWD FORMATION TESTER WITH RETRACTABLE LATCH FOR WIRELINE

TECHNICAL FIELD

The present disclosure relates generally to systems and methods for communicating electrical signals, such as power and data signals, in a well.

BACKGROUND

It is well known in the subterranean well drilling and completion arts to perform tests on formations intersected by a well bore. Such tests are typically performed in order to determine geological and other physical properties of the formations and fluids contained therein. For example, by making appropriate measurements, a formation's permeability and porosity, and the fluid's resistivity, temperature, pressure, and bubble point may be determined. These and other characteristics of the formation and fluid contained therein may be determined by performing tests on the formation before the well is completed. Formation sampling while drilling can be utilized to collect samples of formation fluid while drilling. During sampling while drilling, it can be difficult to obtain a clean sample due to the required power necessary to perform a pumpout operation.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
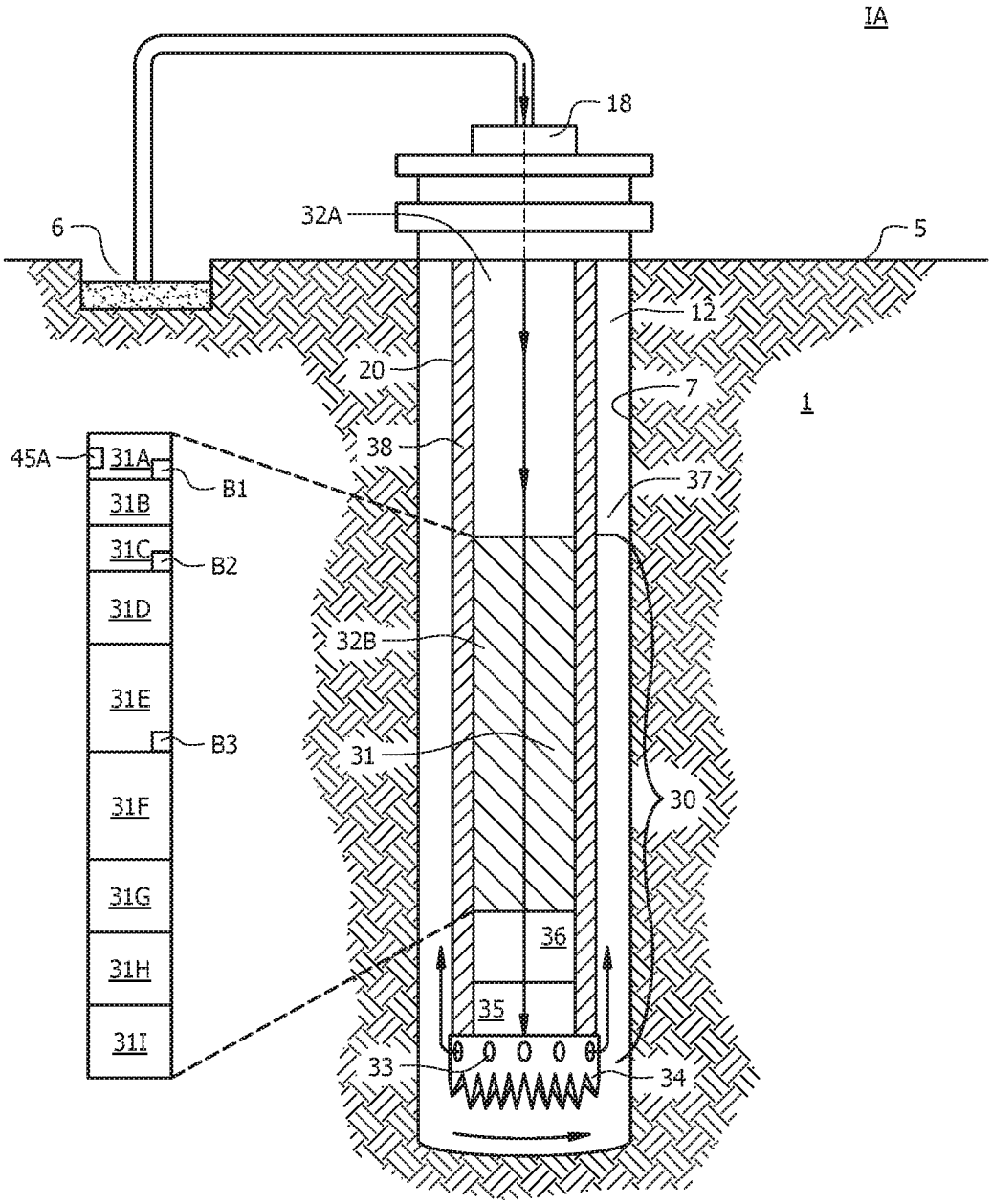
FIGS. 1A-1H provide a sequential series of illustrations showing the drilling of a wellbore and the periodic testing of zones of formations of interest therein in accordance with this disclosure.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

As utilized herein, "electrically coupling" indicates coupling of components (e.g., first component 45A and second component 45B of wet latch assembly 45) whereby an electrical signal (e.g., power and/or data signals) can be transferred between the electrically coupled components.

As utilized herein, the terms 'virgin fluid', 'acceptable virgin fluid', 'uncontaminated fluid', 'virgin sample', and the like are utilized to indicate a subsurface fluid that is pure, pristine, connate, uncontaminated, unadulterated, or otherwise considered in the fluid sampling and analysis field to be sufficiently or acceptably representative (e.g., to have a purity above a desired level and/or a level of contaminants below a desired or "threshold" level) of a given formation for valid hydrocarbon sampling and/or evaluation. A virgin fluid can be representative of the composition of unadulterated formation fluid under ambient formation conditions.

As utilized herein, "flow rate" can refer to volumetric flow rate (e.g., $cm^3/s$).

A descriptor numeral can be utilized generically herein to refer to any embodiment of that component. For example, as described herein, a section or subassembly 31 of BHA 30 can refer to any section or subassembly 31A-31I depicted in FIG. 1A, or any other section or subassembly of a BHA known to those of skill in the art. Similarly, a boot 91 can refer to a first boot 91A and/or a second boot 91B. By way of further example, an electrical connection E can refer to any electrical connection E1-E5 described with reference to FIG. 1E, or any electrical connection between assembled wet latch assembly 45 and a component of formation tester 31B.

Herein disclosed are systems and methods for formation evaluation. Formation evaluation typically requires that fluid from the formation be drawn into a downhole drilling tool and/or a wireline tool for testing and/or sampling. Various devices, such as probes, are typically extended from the downhole tool to establish fluid communication with the formation surrounding the wellbore and to draw fluid into the downhole tool. A typical probe is a circular or prolate element that extends from the downhole tool and is thus positioned against a sidewall of the wellbore. A rubber packer at the end of the probe can be used to create a seal with the sidewall of the wellbore. In applications, a dual packer can be used to form a seal with the sidewall of the wellbore. With a dual packer, two elastomeric rings expand radially above and below the downhole tool to isolate a portion of the wellbore therebetween. The rings form a seal with the sidewall of the wellbore and permit fluid to be drawn into the isolated portion of the wellbore and into one or more inlets in the downhole tool. The mudcake lining the wellbore is often useful in assisting the probe and/or dual packers in making the seal with the sidewall of the wellbore. Once the seal is made, fluid from the formation can be drawn into the downhole tool through one or more inlets by lowering the pressure in the downhole tool relative to ambient formation pressure.

The collection and sampling of underground fluids contained in subsurface formations is well known. In the petroleum exploration and recovery industries, for example, samples of formation fluids are collected and analyzed for various purposes, such as to determine the existence, composition and/or producibility of subsurface hydrocarbon fluid reservoirs. This component of the exploration and recovery process can be crucial for developing drilling strategies, and can significantly impact financial expenditures. To conduct valid fluid analysis, the fluid samples obtained from the subsurface formation should be of sufficient purity, or be virgin fluid, to adequately represent the fluid contained in the formation and thus enable an accurate formation evaluation to be based thereon.

Figure 1B:
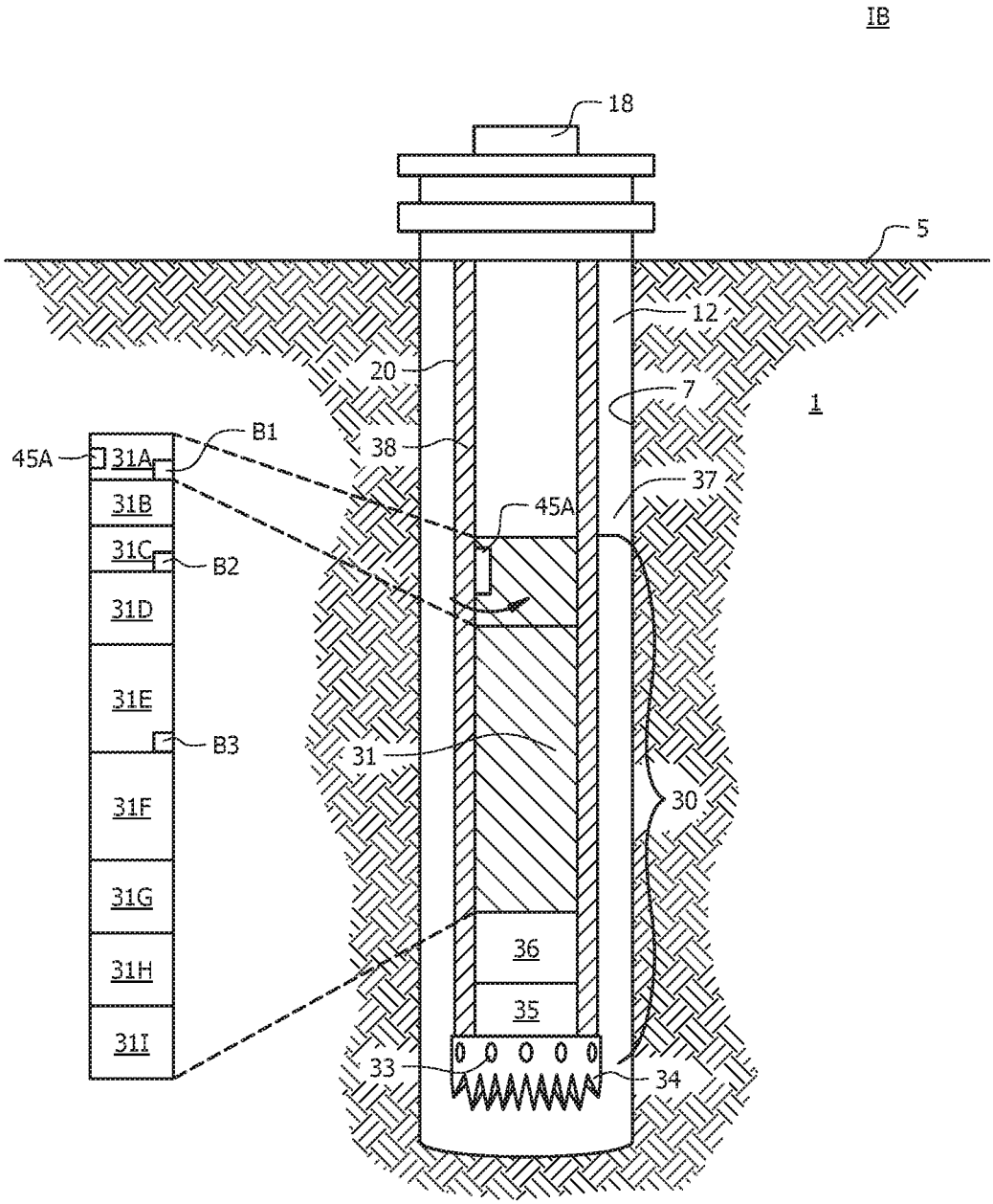
Figure 1C:
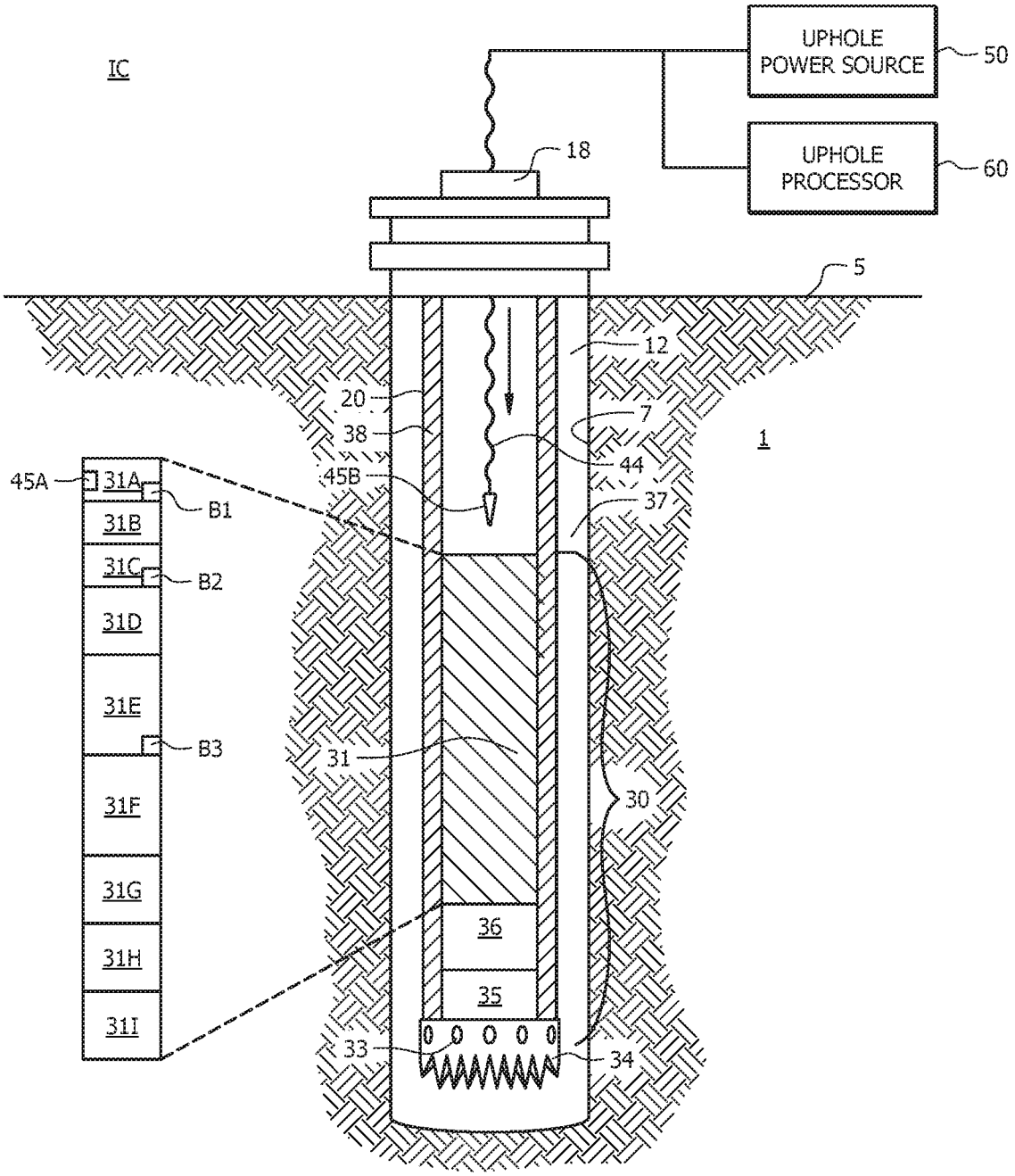
Figure 1D:
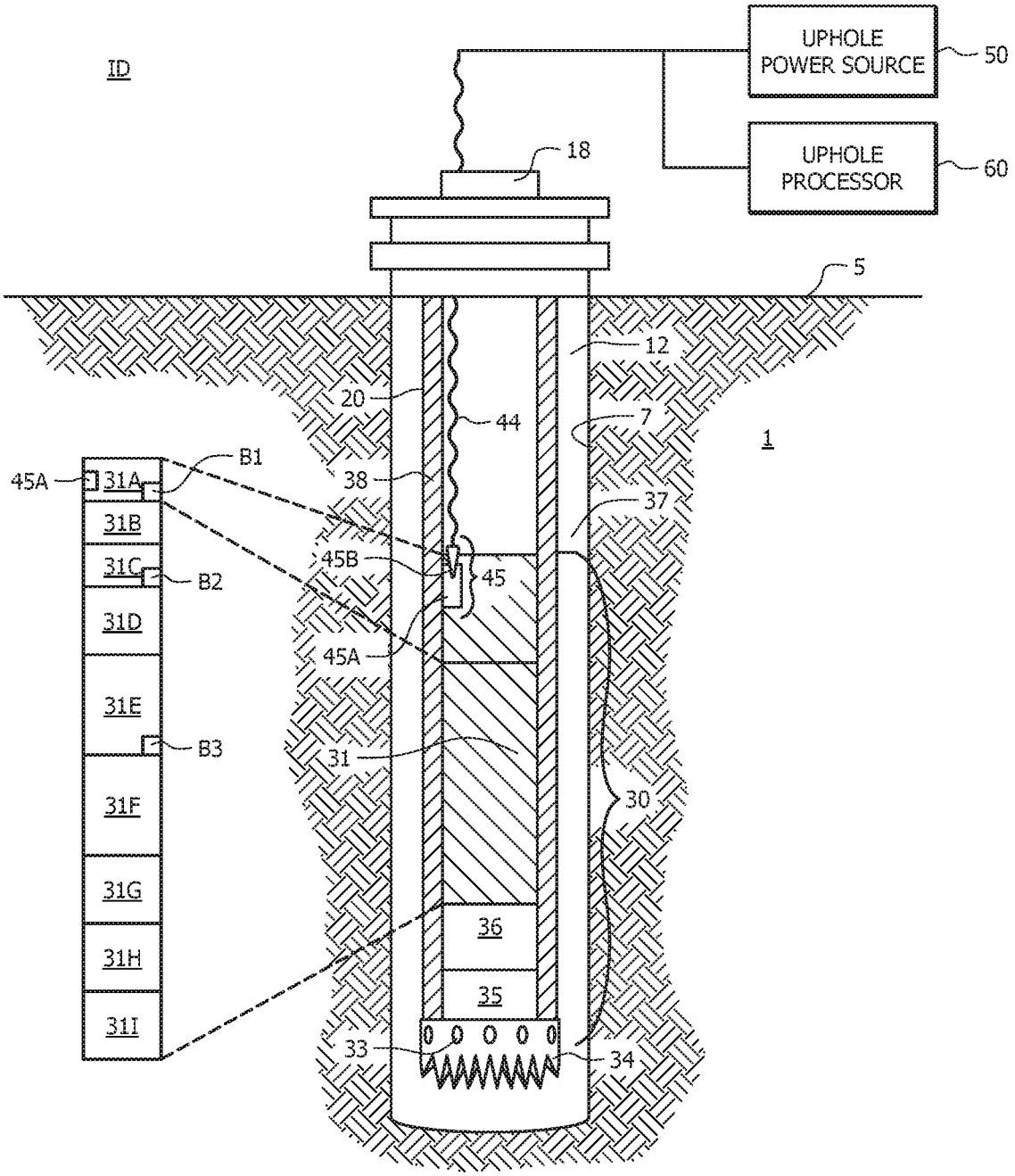
Figure 1E:
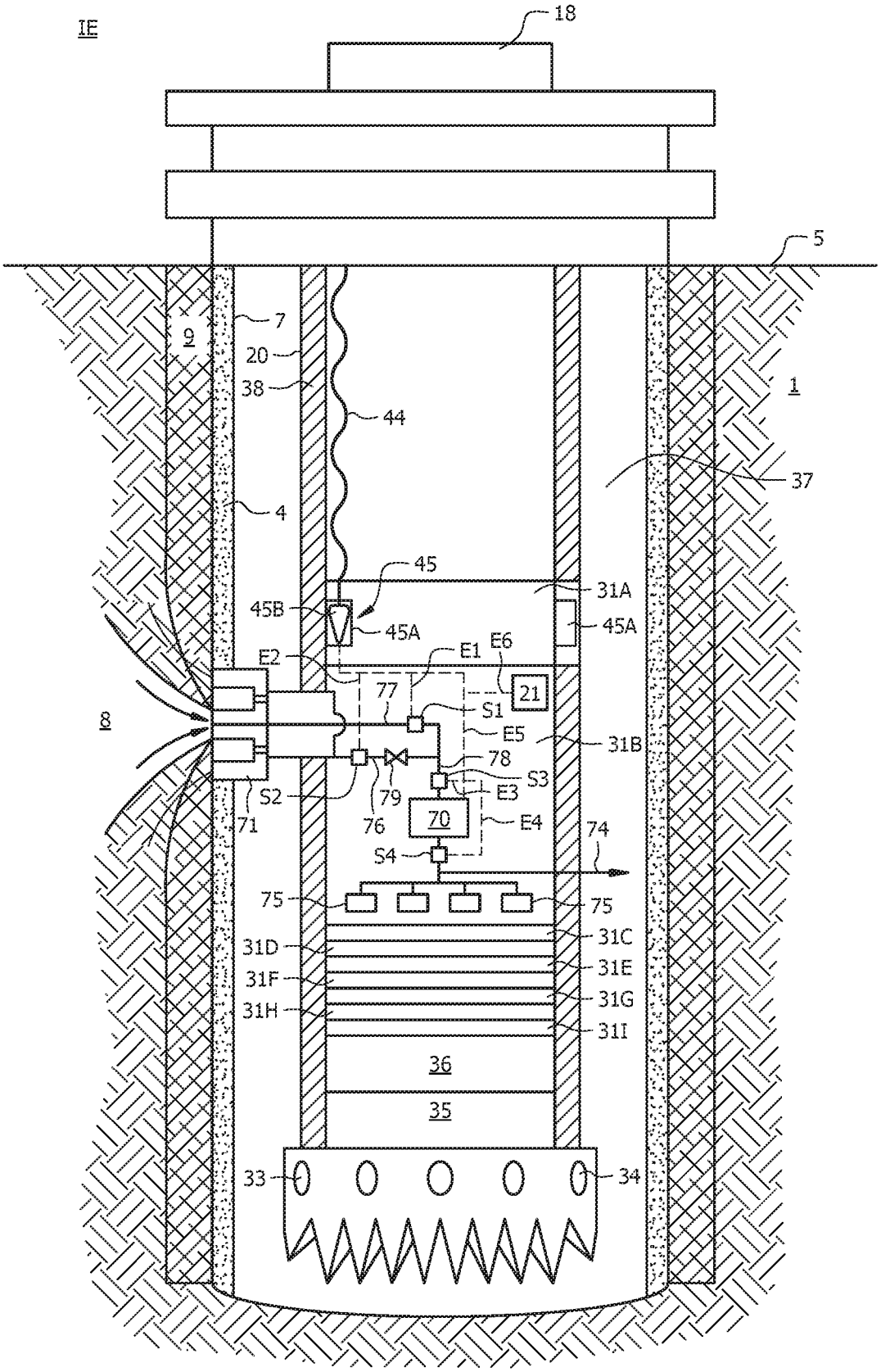

With reference to FIG. 1E, which depicts a subsurface formation 1 penetrated by a wellbore 12 and which be described in more detail hereinbelow, a layer of mudcake (or filter cake) 4 formed by circulation of a drilling fluid (or drilling mud) lines a sidewall (or "wellbore wall") 7 of the wellbore 12. Due to invasion of mud filtrate into the formation 1 during drilling, the wellbore 12 is surrounded by a cylindrical region known and referred to herein as an "invaded" or "dirty" or "contaminated" zone 9. Invaded zone 9 contains contaminated fluid that may or may not be mixed with virgin uncontaminated formation fluid 8. Beyond the sidewall 7 of the wellbore 12 and surrounding contaminated fluid, virgin fluid 8 is located in the formation 1.

As shown in FIG. 1E, contaminants (mud filtrate such as oleaginous fluids) tend to be located near the sidewall 7 of wellbore 12 in the invaded zone 9. FIG. 1E shows the typical flow patterns of the formation fluid as it passes from subsurface formation 1 into a formation sampler (also referred to herein as a "formation tester", "formation sampling device", or "sampling device") 31B. The formation sampler 31B is positioned adjacent the formation 1 and a component, such as a probe 71, of the formation sampler 31B is extended from the formation sampler 31B through the mudcake 4 to the sidewall 7 of the wellbore 12. The probe 71 is placed in fluid communication with the formation 1 so that formation fluid may be passed into the formation sampler 31B. A pumpout is performed to provide uncontaminated fluid to the formation sampler 31B. Initially, during the pumpout, the invaded zone 9 that contains contamination surrounds the sidewall 7 in contact with the probe 71. As fluid initially passes into the probe 71, all or a portion of the fluid drawn into the probe 71 comprises contaminated fluid from invaded zone 9, thereby providing fluid that can be unsuitable for sampling (e.g., having a purity that is below a desired purity and/or a level of contaminants above a desired level of contaminants). However, after a certain amount of fluid passes (e.g., through the probe 71) into the formation sampler 31B, the virgin formation fluid 8 breaks through and begins entering the formation sampler 31B. Formation samplers 31B are generally configured to adapt the flow of the fluid into the probe 71 such that the virgin formation fluid 8 is collected in the formation sampler 31B during the fluid sampling. However, when the formation fluid passes into the formation tester 31B, various contaminants, such as wellbore fluids and/or drilling mud, can enter with the formation fluids. These contaminants can affect the quality of measurements and/or the quality of fluid samples of the formation fluids taken during the sampling process. Additionally, contamination can result in costly delays in the wellbore operations due to the need for additional time for additional testing and/or sampling. Furthermore, such problems may yield results that are inaccurate and/or unreliable for formation evaluation. Accordingly, to increase sample quality, it is desirable that the formation fluid entering into the formation tester 31B be sufficiently uncontaminated for valid testing. The formation fluid samples should have little or no (e.g., less than a threshold value of 10, 9, 8, 7, 6, 5, 4, 3, 2, or 1 weight percent (wt %)) contamination.

In order to perform a formation pumpout, the tool string 18 must typically remain stationary for a number of hours. During this time, mechanical pumps, such as mud motor 36, are actuated in order to draw fluid out of the formation 1 in an effort to flush the near wellbore 12 region with far field formation fluid 8 and clean the fluid stream of near wellbore drilling fluid filtrate contamination in order to acquire a low contamination sample. Unfortunately, the act of circulating mud lengthens the time of pumpout to obtain the cleanest sample possible and also increases a base level of contamination that may be achieved. According to this disclosure, a wet latch assembly is utilized to supply electric power from surface 5 to the formation tester 31B, and mud need not be circulated to provide power. Via the system and method of this disclosure, a level base level of contamination can thus be reduced, due to the absence of the degree of active invasion caused by the circulation of drilling fluid. Furthermore, a time required for a formation pumpout to reach a contamination level sufficiently close to the base level (e.g., to reach a threshold contamination level) can be reduced.

Because the formation tester 31B remains stationary for an extended period of time during the pumpout, a wireline cable 44 can be run through the interior flow bore 32 of the drill string 18 to a first section or subassembly (also referred to herein as a "wet connect collar") 31A of BHA 30, described hereinbelow, whereby a first component (also referred to herein as a "wet connect", a "wet latch", or a "wet connect latch") 45A of a wet latch assembly 45 can be electrically coupled with a second component 45B of the wet latch assembly 45 in order to supply power directly to the formation tester 31B via the assembled wet latch assembly 45. In order for this action to be practical, the first component 45A is retractable or retrievable from the wellbore 12, such as not to experience erosion or other damage during normal operations involving drilling fluid circulation.

The herein disclosed system and method comprise a first component 45A of a wet latch assembly 45 located in a BHA 30. The wet connect latch 45A is either retractable or disconnectable from the BHA 30, such that an interior flow bore 32B of the BHA 30 is not obstructed by the first component 45A during drilling. In other words, the first component or wet connect 45A remains flush with the inner surface of a drill pipe 18 during normal drilling operations (e.g., when drilling fluid is being circulated within flow bore 32 of drill string 18). The first component or wet connect 45A engages (e.g., extends into the interior flow bore 32B of the BHA 30) prior to latching with a wireline cable 44 via a second component 45B of the wet latch assembly 45.

With reference to FIG. 1A, which is a schematic view of a subsurface formation 1 penetrated by a wellbore 12, a system of this disclosure can comprise a drill string 18 comprising a conveyance 20 coupled to a BHA 30. Drill string 18 can comprise drill pipe or coiled tubing. The conveyance 20 comprises an interior flow bore 32A and BHA 30 comprises an interior flow bore 32B, such that a flow bore 32 (comprising flow bore 32A of conveyance 20 and flow bore 32B of BHA 30) extends from the surface 5 to drill bit 34, whereby, during drilling, a drilling fluid can be circulated downhole through the interior flow bore 32 of the drill string 18, through ports 33 in the drill bit 34, and uphole through an annulus 37 between the drill string 18 and sidewalls 7 of the wellbore 12, as indicated by the arrows in FIG. 1A. Formation 1 can be a subsurface formation, a subterranean formation, and a subsea formation. Surface 5 can refer to a surface of the earth or a surface of the sea, from which power is provided (e.g., from a power source 50, such as depicted in FIG. 1C) to a wet latch assembly downhole.

The BHA 30 comprises the first component 45A of the wet latch assembly 45 and a formation tester 31B (also referred to herein as a "formation tester section or subassembly 31B of BHA 30) and has a downhole end comprising the drill bit 34. BHA 30 can comprise a number of other components. For example, BHA 30 can comprise a drill bit sub 35 for connection of the drill string with drill bit 34, a mud motor 36 operable to rotate drill bit 34, and a logging while drilling (LWD)/measuring while drilling (MWD) system (also referred to herein as a "formation testing system") 31. Formation tester 31B can be a component of LWD/MWD system 31. BHA 30 can comprise a number of components and arrangements, as will be apparent to one of skill in the art and with the help of this disclosure.

The first component 45A of the wet latch assembly 45 is extendable into interior flow bore 32B of the BHA 30, and is configured for coupling, when extended into the interior flow bore 32B of the BHA 30, with a second component 45B of the wet latch assembly 45 to provide an assembled wet latch assembly 45, such that an electrical connection can be made between the first component 45A and the second component 45B.

The formation tester 31B is operable for performing a formation test, and is electrically connected with the first component 45A of the wet latch assembly 45, such that power can be provided to the formation tester 31B via the assembled wet latch assembly 45 during the formation test. The formation tester 31B can be a component of an LWD/MWD system 31. In embodiments, the LWD/MWD system 31 comprises one or more MWD sections, subassemblies or downhole tools operable to provide an MWD measurement selected from direction, inclination, survey data, downhole pressure (inside and/or outside drill pipe), resistivity, density, and/or porosity. For example, BHA 30 can comprise a section or subassembly 31D that can be an MWD subassembly configured for measuring direction and/or orientation; a section or subassembly 31F that can be an MWD subassembly configured for measuring pressure; a section or subassembly 31G that can be an MWD subassembly configured for measuring resistivity; and/or a section or subassembly 31I that can be an MWD subassembly configured for measuring density and/or porosity, for example, via gamma ray technology. BHA 30 can further comprise one or more sections or subassemblies comprising processors, such as section or subassembly 31C and section or subassembly 31E of FIG. 1A. Alternatively, a processor may be integrated within another section or subassembly of BHA 30. BHA 30 can further comprise a section or subassembly configured to provide telemetry of data from one or more of the other sections or subassemblies to surface 5 (e.g., to an uphole processor 60, as depicted in FIG. 1C). For example, a telemetry section or subassembly 31H can comprise a mud pulser. In embodiments, the LWD/MWD system 31 comprises one or more LWD sections, subassemblies or downhole tools. The formation tester 31B can comprise a downhole LWD tool configured for taking one or more formation samples, for example, for further analysis after transport uphole. Although formation tester 31B is described hereinbelow as a formation tester operable to take one or more samples of fluid from formation 1 for transport uphole, in applications, the formation tester to which power is provided via the wet latch assembly 45 described herein can be another component of a BHA 30, such as one or more of the sections or subassemblies 31 described herein, or another section or subassembly 31 known to those of skill in the art. The arrangement and components of subassemblies 31A-31I of FIG. 1A is intended to be exemplary, rather than exhaustive, and other components/sections/subassemblies of a BHA and arrangements thereof can be included in a BHA 30 of this disclosure, provided the BHA comprises a first component 45A of a wet latch assembly 45 as described herein.

The BHA 30 can further comprise one or more rechargeable batteries. By way of non-limiting example, in FIG. 1A, battery B1 is associated with first section or wet latch collar 31A, battery B2 is associated with processor 31C, and battery B3 is associated with processor 31E. One or more of the rechargeable batteries of the BHA 30 can be electrically connected with the first component 45A of the wet latch assembly 45, such that power can be provided to the battery via the assembled wet latch assembly 45. Battery B1 can be operable to initiate extension of first component 45A into interior flow bore 32B of BHA 30 and/or retraction of first component 45A from interior flow bore 32B of BHA 30.

The formation tester 31B and/or another component of the BHA 30 can be electrically connected with the first component 45A of the wet latch assembly 45, such that telemetry of data can be provided from the formation tester 31B and/or from the another component of the BHA 30 uphole via the assembled wet latch assembly 45. For example, in embodiments, telemetry sub 31H is electrically connected with the first component 45A of the wet latch assembly 45, such that data obtained by one or more downhole tools of BHA 30 can be telemetered from the BHA 30 to the surface 5 (e.g., to an uphole processor 60, as depicted in FIG. 1C).

As depicted in the embodiment of FIG. 1A, the first component 45A of the wet latch assembly 45 can be located in a first or "top" section or subassembly 31A (also referred to herein as a "wet latch collar") of BHA 30, wherein the first subassembly of the BHA is distal the drill bit 34. Prior to use the first component(s) 45A can be positioned within first section 31A such that a smooth interior flow bore 32B is maintained within an interior of BHA 30. The first component(s) 45A are extendable into interior flow bore 32A of BHA 30 during assembly of wet latch assembly 45 and while coupled with second component 45B. As described further hereinbelow, the first component(s) 45A can be retractable back into first section 31A of BHA 30, such that, upon disassembly of wet latch assembly 45 (e.g., upon disconnecting of first component 45A from second component 45B), first component 45A can be retracted back into first section 31A of BHA 30, such that a smooth interior flow bore 32B is once again provided within the interior of BHA 30. A signal from uphole (e.g., from processor 60 depicted in FIG. 1C) can be utilized to initiate extension and/or retraction of first component 45A. Alternatively, as also described further hereinbelow, first component(s) 45A can be configured for disconnection from first section 31A subsequent use thereof in a wet latch assembly 45, whereby the first component 45A can remain attached to second component 45B and removed from wellbore 12 via wireline cable 44. That is the first component 45A can be retractable back out of the portion of the interior flow bore 32B of the BHA 30 within first section 31A subsequent extension of the first component 45A into the portion of the interior flow bore 32B during the performing of a formation test or the first component 45A can be designed for breakaway from the BHA 30 subsequent the performing of the formation test. For example, the first component 45A can be spring loaded for extension into the interior flow bore 32B of the BHA or for retraction from the interior flow bore 32B of the BHA 30. Thus, in embodiments, first component 45A can be configured for extension into interior flow bore 32B of BHA 30 during formation of wet latch assembly 45 and retraction from interior flow bore 32B of BHA 30 subsequent decoupling from second component 45B of wet latch assembly 45 subsequent use, while in alternative embodiments, first component 45A is configured for extension into interior flow bore 32B of BHA 30 for formation of wet latch assembly 45 and breakaway from BHA 30 subsequent to use of wet latch assembly 45. In such embodiments, the first component 45A is designed such that a certain tension on wireline assembly 44 while wet latch assembly 45 is assembled will cause breakaway of first component 45A from BHA 30. As will be apparent to one of skill in the art, such tension should be such that first component 45A will not breakaway from BHA 30 prior to completion of formation testing (e.g., during use of wet latch assembly 45 during formation testing).

Figure 2A:
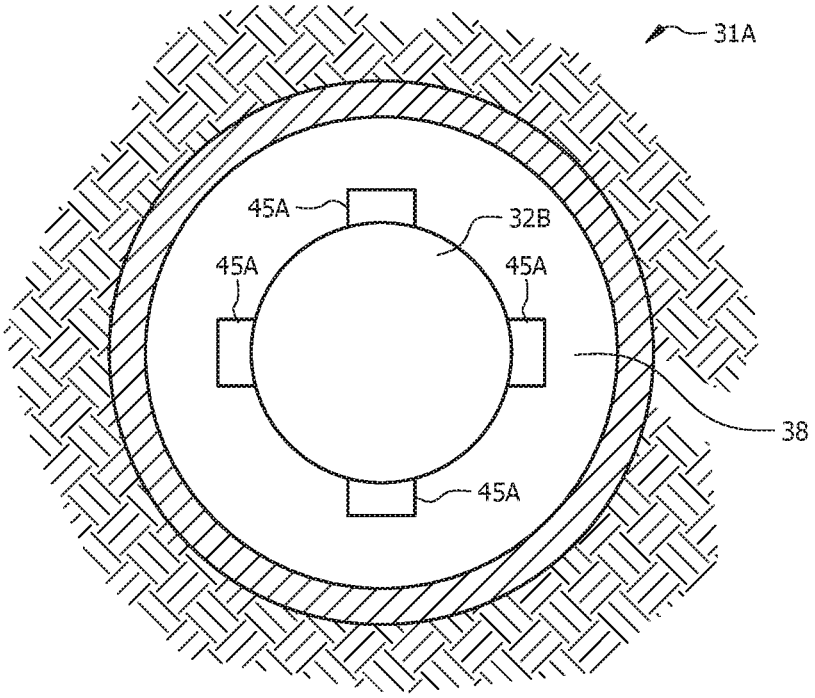
FIG. 2A is a schematic radial cross section view of a first (e.g., top, for vertical wells) section of a bottom hole assembly (BHA)
Figure 2B:
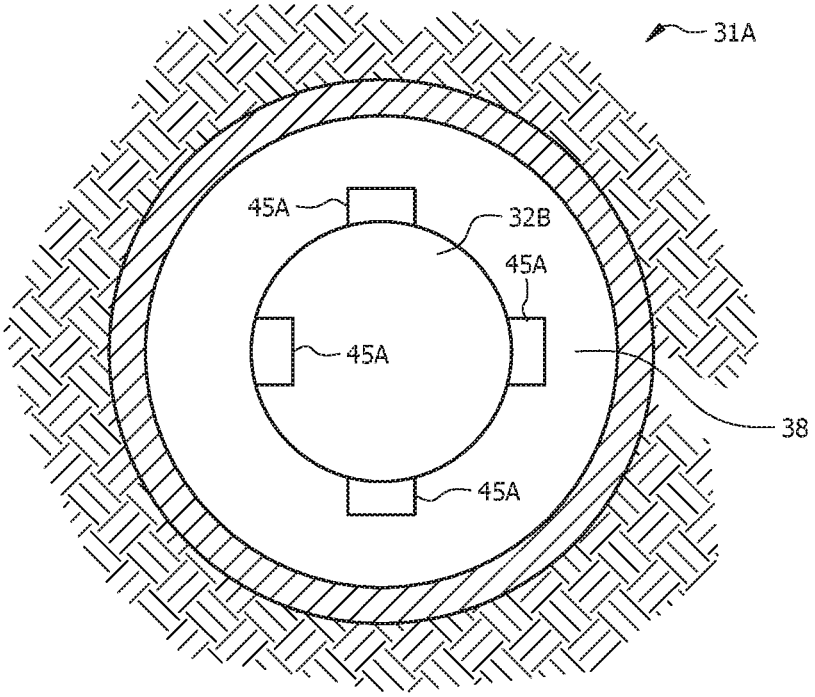
FIG. 2B is a schematic radial cross section view of the first section of the BHA of FIG. 2A, in which one of the first components is shown extended into the interior flow path of the BHA.

First section 31A of BHA 30 can comprise one or a plurality of (e.g., multiple, two, three, four, five, six, seven, eight, nine, or ten or more) first components 45A suitable for coupling with a second component 45B to provide a wet latch assembly 45. The first section 31A (e.g., the wet connect collar) may contain multiple (e.g., from 2 to 10, from 3 to 9, or from 2 to 8) first components 45A (e.g., wet connects) for redundancy or multiple use. For example, as depicted in the embodiment of FIG. 2A, which is a schematic radial cross section view of an exemplary first section 31A of a BHA 30 according to this disclosure, the wet latch collar 31A can comprise four first components 45A, each shown, in FIG. 2A, in a retracted position within walls 38 of first section 31A of BHA 30. FIG. 2B is a schematic radial cross section view of the first section 31A of the BHA 30 of FIG. 2A, in which one of the first components 45A is extended into the interior flow bore 32B of the BHA 30, prior to coupling thereof with a second component 45B of a wire latch assembly 45.

Figure 3A:
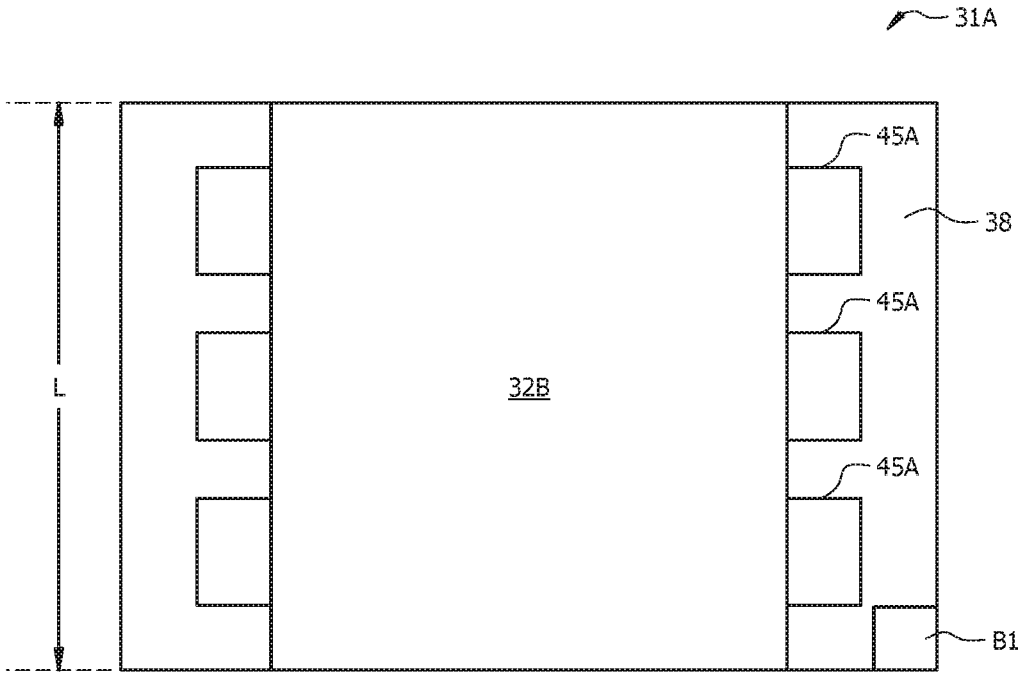
FIG. 3A is a schematic axial cross section view of a first section of a BHA.

In embodiments comprising a plurality of first components 45A, the plurality of first components 45A can be spaced radially apart about an interior circumference of first section 31A that defines the portion of interior flow bore 32B of BHA 30 within first section 31A. Alternatively or additionally, as depicted in FIG. 3A, which is a schematic axial cross section view of an exemplary first section 31A of a BHA 30 comprising a plurality of (e.g., six) first components 45A in a retracted position, according to embodiments of this disclosure, the plurality of first components 45A can be spaced axially apart along a length L of first section 31A.

As noted hereinabove, the first component 45A of the wet latch assembly 45 can be located in a first subassembly 31 of the BHA 30. The first subassembly 31B of the BHA 30 can be threadably connected with a last section of the conveyance 20, which conveyance can comprise, for example, drill pipe or coiled tubing. The last section of the conveyance 20 (e.g., of the drill pipe or coiled tubing) is a section of the conveyance 20 (e.g., coiled tubing or drill pipe) extending farthest into the wellbore 12 (e.g., farthest from surface 5 for a vertical wellbore 12). Although depicted as being in a separate section or subassembly 31 of BHA 30 in FIG. 1A, it is to be understood that first component(s) 45A can be located in a same section or subassembly 31 as the formation tester and/or can be located in a section or subassembly 31 of BHA 30 other than the first section or subassembly 31A of BHA 30. For example, first component(s) 45A can be located in any of sections or subassemblies 31A-31I of FIG. 1A. Without limitation, to facilitate coupling of the first component 45A with the second component 45B, it may be desirable for first component 45A to be in the first or at least an upper section or subassembly 31 of BHA 30. In embodiments, the first component 45A is located in a section or subassembly (e.g., a wet latch collar or within a section or subassembly of BHA 30 comprising formation tester 31B) above a mud pulse telemetry section or subassembly (e.g., telemetry section or subassembly 31H). In embodiments, the first component 45A is part of (e.g., within) the formation testing section or subassembly 31B. In embodiments, the first component 45A is located in a wet connect collar comprising the first section or subassembly 31A of the BHA 30 such that the wireline cable 44 need not traverse a majority (e.g., traverses a minority of a length) of the BHA 30 to make the connection of the second component 45B with the first component 45A of the wet latch assembly 45.

Figure 3B:
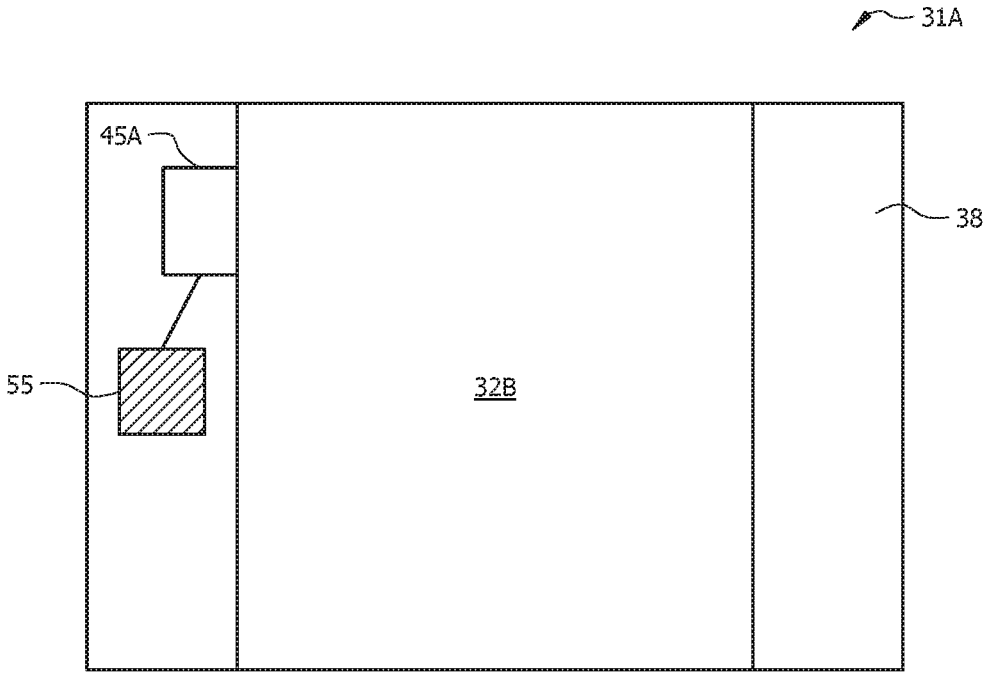
FIG. 3B is a schematic axial cross section view of a first section of a BHA, depicting a fluid reservoir.

A sealing mechanism on the first component or wet connect 45A can be operable to prevent drilling fluid from entering the wet connect housing (e.g., contact(s) housing 86 described hereinbelow with reference to FIG. 4A) when it is retracted. The first component or wet connect 45A can contain an extended fluid reservoir for an exclusion fluid to enable multiple uses of a first component 45A. For example, as depicted in FIG. 3B, each first component(s) 45A can be in fluid communication with a (e.g., devoted or common) fluid reservoir 55, such that fluid from the fluid reservoir 55 can be utilized to provide a positive pressure within a cavity within first section 31A around the first component 45A during retraction thereof out of interior flow bore 32B of BHA 30, such that drilling mud can be excluded from retraction into first section 31A along with the first component 45A. In applications in which a first component(s) 45A is designed for multiple uses, the fluid reservoir 55 can be an extended reservoir 55 comprising sufficient fluid to exclude ingress of drilling fluid into first section 31A during multiple retractions of the first component 45A out of interior flow bore 32B of BHA 30. Fluid reservoir 55 can comprise, for example, a piston.

The first component of the wet latch assembly 45 can comprise a first contact component and the second component of the wet latch assembly 45 can comprise a second contact component. When the first component is coupled with the second component, an electrical signal can pass through the second contact component to the first contact component. The first contact component can comprise one or more contacts and the second contact component can comprise one or more contact receivers designed for electrically coupling with the contacts. In embodiments, the first component comprises a number of contacts and the second component comprises a same number of the contact receivers. For example, with reference to the embodiment of FIG. 4A, the first contact component can comprise a plug 80 comprising one or more pins 85, optionally within a contact(s) housing 86. Each pin 85 can have a tip 81 that makes the electrical contact and a length L of each pin 85 can comprise an insulator. The tip can be any conductive material, for example, gold or gold plated.

Figure 4A:
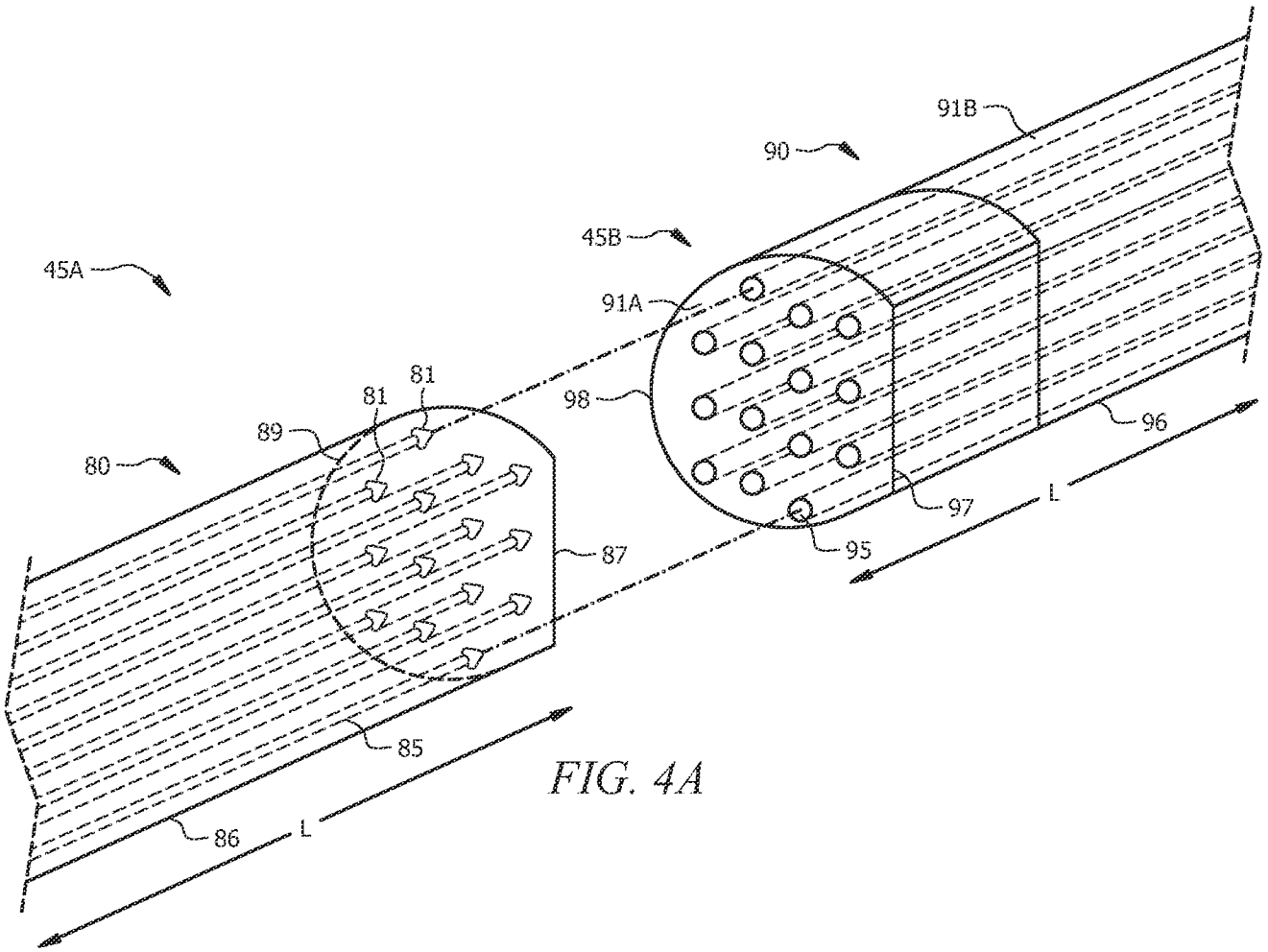
FIG. 4A is a schematic view of a wet latch assembly comprising a plug of a first component of a wet latch assembly, and a jack of a second component of the wet latch assembly, according to this disclosure.

With reference to the embodiment of FIG. 4A, the second contact component can comprise a number of contact receivers comprising cavities or holes 95 within a housing comprising one or more (e.g., fluid filled) boots 91. The cavities or holes 95 can be surrounded, within boot(s) 91 by a fluid, which can be an insulating fluid that is retained within boot(s) 91. The material of the boot(s) 91 surrounds the contact receivers 95, preventing ingress of (e.g., drilling) fluids thereto. That is, cavities 95 are recessed within contact receiver(s) housing 96, such that contact receiver(s) housing 96 extends thereover, and the contacts have to pass through the material of boot(s) 91 in order to make contact with contact receiver(s) 95. Desirably, especially for multi-use operation, the material of boot(s) 91 comprises a self-healing material, such that holes pierced therethrough during assembly of wet latch assembly 45 are sealed against fluid ingress upon separation of first component 45A from second component 45B. The fluid of which the boot(s) can be filled can be any insulating fluid such as, for example, silicon oil. First component 45A, second component 45B, or both can comprise (e.g., fluid filled) boot(s) 91, contact(s) 85, and corresponding cavities 95. That is, both first component 45A and second component 45B can comprise (e.g., fluid filled) boot(s) 91, in embodiments, and, although depicted in FIG. 4A with first component 45A comprising contact(s) 85, and with second component 45B comprising contact receiver(s) 95, in alternative embodiments, second component 45B comprises contact(s) 85, and first component 45A comprises contact receiver(s) 95.

In embodiments, such as depicted in FIG. 4A, second component 45B comprises a jack 90 comprising a plurality of boots, such as first boot 91A and second boot 91B. Each of the plurality of boots 91 can be fluidly isolated from the remainder of the boots 91, such that fluid from each of the boots 91 cannot flow into another of the boots 91. As depicted in FIG. 4A, the plurality of boots 91 can be spaced along a length L of contact receiver(s) housing 96. The one or more holes 95 of jack 90 are configured to accept the one or more pins 85 of the plug 80. The contact(s) housing 86 and/or the contact receiver(s) housing 96 of the first component 45A and/or the second component 45B, respectively, can comprise a rubber and/or fluid filled housing, such that the first contact component of the first component, the second contact component of the second component, or both can be wiped clean during coupling and/or de-coupling of the first component and the second component. For example, as pins 85 of first component 45A pass through the material (e.g., rubber) of second component 45B, during connection/coupling of first component 45A with second component 45B, pins 85 can be cleaned by the wiping action of the material and the fluid within the boot(s) 91 on the pins 85.

The shape of first component 45A and the shape of second component 45B can be complementary, to facilitate coupling of the first component 45A with the second component 45B during assembling of wet latch assembly 45. The shape of first component 45A, second component 45B, or both can be asymmetric or otherwise designed to facilitate coupling of the first component with the second component during assembling of wet latch assembly 45.

The shape of the second component (e.g., jack 90 or contact receiver(s) housing 96) can be complementary to the shape of the first component (e.g., plug or contact(s) housing 86). For example, with reference back to FIG. 4A, contact receiver(s) housing 96 can have a cross section comprising a vertical section 97 and a cylindrical section 98, and contact(s) housing 86 can have a cross section comprising a complementarily shaped vertical section 87 and a cylindrical section 89, whereby coupling of the first component 45A with the second component 45B in a desired orientation can be facilitated. In embodiments, a twist shape of first component 45A can facilitate coupling thereof with a complementarily twist shaped second component 45B.

Figure 4B:
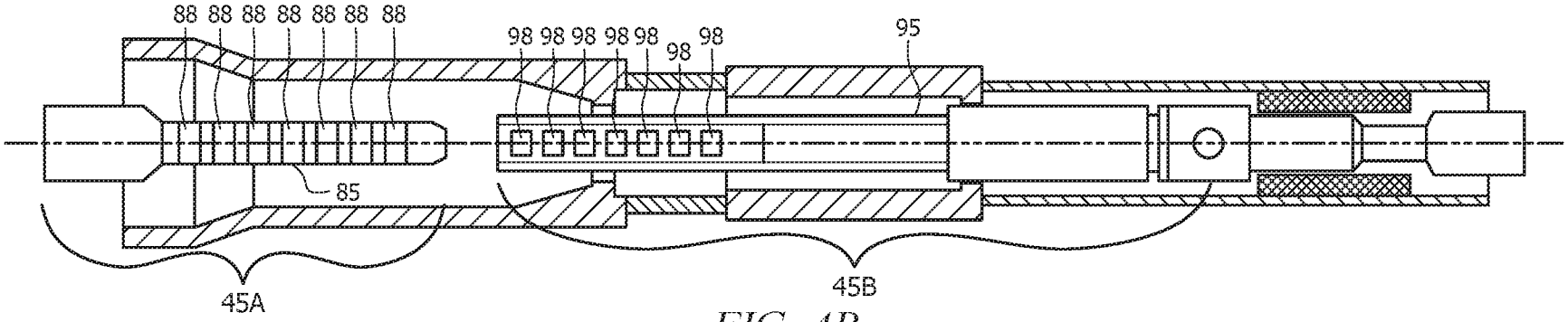
FIG. 4B is a schematic view of a wet latch assembly comprising a contact of a first component of a wet latch assembly, and a contact receiver of a second component of the wet latch assembly.

FIG. 4B is a schematic view of another wet latch assembly comprising a first component 45A and a second component 45B. In this embodiment, first component 45A comprises one or more pins 85 comprising one or a plurality of contact surfaces 88, and second component 45B comprises one or more contact receivers or cavities 95 comprising a corresponding one or the plurality of contact surfaces 98. During assembly of wet latch assembly 45, upon insertion of the one or more pins 85 of first component 45A of wet latch assembly 45 into the one or more cavities 95 of second component 45B of wet latch assembly 45, contact surfaces 88 of first component 45A contact surfaces 98 of second component 45B of wet latch assembly 45, such that the electrical connection is made between an uphole component (e.g., power source 50 and/or uphole processor 60) at surface 5 and the assembled wet latch assembly 45.

When second component 45B of the wet latch assembly 45 is coupled with the first component 45A of the wet latch assembly 45, the electrical connection is made between the first component 45A and the second component 45B, such that power can be provided to BHA 30 via uphole power source 50 (FIG. 1C). The assembled wet latch assembly 45 provides the electrical connection without being adversely affected by fluid in the well capable of short-circuiting an electric circuit. The electrical connection can be a high voltage electrical connection, in embodiments. As depicted in FIG. 1C, which is a schematic of wellbore 12 during formation of wet latch assembly 45, second component 45B is attached to a logging (e.g., wireline) cable 44 (also referred to simply as "wireline") that extends to a surface 5 from which the drill string 18 extends. Wireline cable 44 is electrically connected with power source 50 and can be electrically connected with an uphole processor 60.

As discussed further hereinbelow with reference to FIG. 1E, formation tester 31B can further comprise a sampling probe 71. Sampling probe 71 can be configured for contacting the wellbore wall 7 during pumping of formation fluid from the formation 1 through the wellbore wall 7 into the formation tester 31B via the sampling probe 71 during the performing of the formation test.

Figure 5:
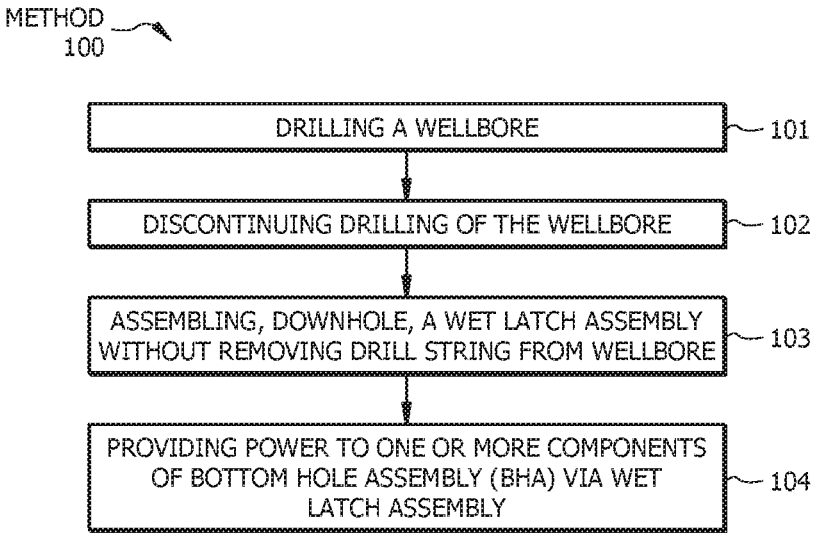
FIG. 5 is a flow chart of a method of this disclosure.

A method of this disclosure will now be described with reference to FIG. 5 and FIGS. 1A-1H. As depicted in FIG. 5, a method 100 of this disclosure can comprise drilling a wellbore 12 at step 101, discontinuing drilling of the wellbore 12 at step 102, assembling, downhole, a wet latch assembly 45 (as described herein), without removing a BHA 30 from the wellbore 12 at step 103, and providing power to one or more components of a BHA 30 via the wet latch assembly 45 at step 104.

With reference now to FIG. 1A, drilling the wellbore 12 at 101 can comprise drilling via any methods known to those of skill in the art. Generally, drilling can comprise drilling with drill string 18, a well comprising an uncased wellbore 12 intersecting a subsurface zone of interest. As noted above, the drill string 18 can comprise a conveyance 20 and a BHA 30 coupled to the conveyance 20. The BHA is a BHA as described hereinabove, comprising a formation tester 31B and having a downhole end comprising a drill bit 34. The conveyance 20 and the BHA 30 each have an interior flow bore (32A, 32B, respectively) and together provide the drill string 18 with an interior flow bore 32 extending from the surface 5 to the drill bit 34. Drilling can comprise drilling with the drill bit 34 (e.g., rotating the drill bit 34 or cutters thereof, as indicated by the arrow below drill bit 34 in FIG. 1A), while circulating a drilling fluid (e.g., from a mud pit 6) through the interior flow bore 32 of the drill string 18, through ports 33 in the drill bit 34, and through an annulus 37 between the drill string 18 and walls 7 of the wellbore 12.

Method 100 comprises discontinuing drilling of the well by ceasing the drilling with (e.g., rotating of) the drill bit 34 at step 102. Method 100 further comprises assembling, downhole, a wet latch assembly 45, without removing the BHA 30 from wellbore 12. Assembling the wet latch assembly 45 comprises extending, into the interior flow bore 32B of the BHA 30, first component 45A of a wet latch assembly 45 to provide an extended first component 45A of the wet latch assembly 45, as depicted in FIG. 1B. Extending the first component or wet connect 45A can be responsive to a signal received by the BHA 30 from the surface 5 (e.g., from uphole processor 60). For example, and without limitation, such a signal can comprise a pulsed telemetry signal, an electromagnetic (EM) signal, an acoustic signal, or the like. In embodiments, a downlink command is utilized to extend first component 45A into interior flow bore 32B of BHA 30. Alternatively or additionally, a proximity sensor can be utilized to initiate extension of first component 45A into interior flow bore 32B of BHA 30 when second component 45B gets within a certain distance of first component 45A. The extension and/or retraction mechanism of the first component 45A can be battery or electro-hydraulically operated.

As depicted in FIG. 1C, assembling the wet latch assembly 45 can further comprise, conveying downhole (as indicated by the arrow adjacent wireline cable 44 in FIG. 1C) via wireline cable 44, from the surface 5 and through the interior flow bore 32 provided by the drill string 18, second component 45B of the wet latch assembly 45. The second component 45B can be conveyed downhole through the interior flow bore 32B provided by the drill string 18 via circulation of the drilling fluid. The drilling fluid can be circulated downhole at a first rate during the drilling, and circulated downhole at a second rate during the conveying downhole of the second component 45B. The second rate can be less than the first rate, for example, so as not to damage the second component 45B and/or the first component 45A. For example, in embodiments, the second rate is 10, 25, or 50% less than the first rate. In alternative embodiments, the second component is conveyed downhole on the wireline 44 by gravity. The first component can be extended into interior flow bore 32B pf BHA 30 before, during, or subsequent the conveying downhole of the second component 45B via wireline cable 44.

Assembling the wet latch assembly 45 can further comprise, as depicted in FIG. 1D, coupling the second component 45B of the wet latch assembly 45 with the extended first component 45A of the wet latch assembly 45, such that an electrical connection is established between the first component 45A and the second component 45B and between the BHA 30 and the surface 5 via the wireline cable 44. Coupling the second component 45B with the first component 45A can comprise aligning the first component 45A and the second component 45B, and inserting contact(s) 85 into contact receiver(s) 95 or otherwise electrically coupling first component 45A with second component 45B. For example, with reference to FIG. 4A, electrically coupling first component 45A and second component 45B can comprise aligning first component 45A and second component 45B, and piercing through contact receiver(s) housing 96 with contact(s) 85. As contact(s) 85 pass through fluid filled boots 91A and 91B, contact(s) 85 are wiped clean of any drilling fluid prior to contacting contact receiver(s) 95, such that a good electrical connection is formed via assembled wet latch assembly 45. The first component 45A and the second component 45B are configured such that a good electrical connection therebetween can be made albeit the wet latch assembly 45 can be surrounded by a conductive fluid (e.g., drilling fluid).

As noted above, method 100 further comprises providing power to one or more components of BHA 30 via the assembled wet latch assembly 45 at step 104. Upon establishing the electrical connection/coupling of the first component 45A and the second component 45B, circulation of drilling fluid can be discontinued. Providing power to the one or more components of BHA 30 via the assembled wet latch assembly 45 at step 104 can comprise testing the formation 1 with the formation tester 31B, wherein testing the formation 1 comprises providing power to the formation tester 31B from the surface 5 (e.g., from power source 50) via the wet latch assembly 45 and the wireline cable 44. As detailed hereinabove, the formation tester 31B can comprise a logging while drilling (LWD) tool and/or a measurement while drilling (MWD) tool, such as a MWD or LWD tool, described hereinabove with reference to sections or subassemblies 31B-31I of FIG. 1A, or another MWD or LWD tool known to those of skill in the art.

Testing the formation can be performed by any methods known to those of skill in the art, so long as power for the formation testing is provided at least in part via assembled wet latch assembly 45, such assembled wet latch assembly 45 depicted in FIG. 1E. Although depicted as off-center in the embodiment of FIG. 1E, wet latch assembly 45 can be centralized or decentralized within interior flow bore 32B of BHA 30. By way of example and with reference to FIG. 1E, testing the formation 1 can comprise contacting the wellbore wall 7 with a sampling probe 71 of the formation tester 31B and pumping formation fluid from the formation 1 through the wellbore wall 7 and probe 71 into the formation tester 31B. Probe 71 can be extended from formation tester 31B and positioned within wellbore 12 such that a section of the wellbore is isolated from a remainder of the wellbore 12. Testing the formation 1 can further comprise determining an amount of a near wellbore contaminant present in the formation fluid 8. Testing the formation 1 can further comprise pumping formation fluid from the formation 1 for a period of pumpout time sufficient for the amount of the near wellbore contaminant present in the formation fluid to be reduced to at or below a threshold level of contamination suitable for sampling. In applications for which the drilling fluid is an oil based drilling fluid, the near wellbore contaminant can comprise an oleaginous filtrate from a filter cake 4 deposited on the walls 7 of the wellbore 12 by the oil based drilling fluid. Power for this pumpout and/or telemetry can be provided via the electrical connection with wet latch assembly 45. For example, dotted line E1 indicates the electrical connection between wet latch assembly 45 and first fluid ID sensor S1, dotted line E2 indicates the electrical connection between wet latch assembly 45 and second fluid ID sensor S2, dotted line E3 indicates the electrical connection between wet latch assembly 45 and third fluid ID sensor S3, dotted line E4 indicates the electrical connection between wet latch assembly 45 and fourth fluid ID sensor S4, dotted line E5 indicates the electrical connection between wet latch assembly 45 and pump 70 of the formation tester of section or subassembly 31B of BHA 30 in FIG. 1E, and dotted line E6 indicates the electrical connection between wet latch assembly 45 and processor hub 21 of the formation tester of section or subassembly 31B of BHA 30 in FIG. 1E. Power and/or data can be provided from surface 5 to one or more components (e.g., sensors S1-S5, pump 70, processor 21, etc.) of the formation tester of section or subassembly 31B, and/or vice versa, via the electrical connections (E) of the one or more components with wet latch assembly 45. In embodiments, one or more components of formation tester 31B, such as, without limitation, pump 70, any one or more of sensors S1-S5, can be electrically connected with processor hub 21 and said processor hub 21 directly electrically connected with assembled wet latch assembly 45, such that the one or more components can be indirectly connected with assembled wet latch assembly 45 via processor hub 21. Alternatively, one or more components can be directly electrically with assembled wet latch assembly 45.

Due to powering of formation tester 31B via wet latch assembly 45 (and the concomitant absence or reduced amount of drilling fluid circulation during the pumpout), a pumpout time sufficient for the amount of the near wellbore contaminant present in the formation fluid to be reduced to a level at or below the threshold contamination level can be reduced relative to a pumpout time sufficient for the amount of the near wellbore contaminant present in the formation fluid to be reduced to the level at or below the threshold level via a formation tester 31B powered via circulation of wellbore drilling fluids. In embodiments, due to powering of formation tester 31B via wet latch assembly 45 (and absence of drilling fluid circulation during the pumpout), a pumpout can provide a formation sample having a level of contamination below (e.g., 1, 2, 3, 4, 5, 6, 7, 8, 9, or 10% less than) a level of contamination obtainable via a same formation tester 31B powered by circulation of wellbore drilling fluids. The threshold contamination level can be less than or equal to about 10, 9, 8, 7, 6, 5, 4, 3, 2, or 1 weight percent (wt %) contamination.

In embodiments, formation tester 31B comprises a focused or partially focused formation sampling apparatus. The terms "focused sampling" and "focused formation sampling" can refer to sampling (focused or partially focused) of a formation by manipulating the location of clean and contaminated formation fluid in the region of the formation in which the sampling is performed. The system and method of this disclosure can be utilized to provide power to a downhole formation tester to perform a formation sampling test that can provide one or more at least partially focused samples. In such applications, a single pump 70 of formation tester 31B can pump formation fluid via a sampling line 77 and a guard line 78 from a sampling zone and a guard zone, respectively, and a common line 78 to a discard line 74, configured to discard the fluid from the common line to the formation 1, or to one or more sample chambers 75, into which sample(s) of clean formation fluid can be collected for transport uphole for further formation evaluation. A flow restrictor can be utilized to restrict flow of fluid from guard line 76 during introduction of formation fluid into the one or more sample chamber(s) 75. One or more fluid identification (ID) sensors S can be located on the guard line 76, the sample line 77, and/or the common line 78, before or after pump 70, to determine when the pumpout time has been sufficient for the amount of the near wellbore contaminant present in the formation fluid in the sample line 77 to be reduced to the level at or below the threshold contamination level for sample collection in the one or more sample chambers 75. In the embodiment of FIG. 1E, a first fluid ID sensor S1 is on sample line 77, a second fluid ID sensor S2 is on guard line 76, a third fluid ID sensor S3 is on common line 78 upstream of pump 70, and a fourth fluid ID sensor S4 is on common line 78 downstream of pump 70. Additional sensors S can be utilized, in applications. Each sensor S can be electrically connected directly with wet latch assembly 45 and/or connected with a processor 21 within formation tester 31B that is itself electrically connected with wet latch assembly 45. Testing the formation 1 can comprise sampling the formation fluid (e.g., obtaining measurements of the formation fluid after pumpout via at least one of the one or more sensors S) and/or storing a sample of the formation fluid in the one or more sample chambers 75 of formation tester 31B. In such applications, advantages of full focused sampling, can be obtained with a single pumpout system, while providing power to the formation tester via the assembled wet latch assembly 45.

As an added advantage of the herein disclosed system and method, telemetry can also be supplied during the pumpout operations so that high resolution data can be transmitted uphole. The rate of wire line 44 telemetry is often on the order of a few (e.g., greater than or equal to about 1, 2, 3, 4, or 5) megabits (Mb)/s; thus, over the course of the few hours needed for a typical pumpout, data from a memory of the BHA (e.g., from processor section or subassembly 31C and/or processor section or subassembly 31E) can be uploaded to the surface 5 (e.g., to uphole processor 60) during the pumpout. Accordingly, in embodiments, method 100 further comprises supplying data telemetry from the formation tester 31B and/or from another component or subassembly 31 (e.g., section or subassembly 31C-31I in FIG. 1A) of the BHA 30 to the surface 5 via the electrical connection provided by wet latch assembly 45. For example, data telemetry from the formation tester 31B to the surface 5 can be provided via the electrical connection of wet latch assembly 45, which data telemetry can be indicative of the amount of the near wellbore contaminant present in the formation fluid. Such applications can further comprise analyzing, at the surface 5, the data telemetry to determine an amount of the near wellbore contaminant present in the formation fluid and whether to initiate sampling of the formation fluid based upon the amount of the near wellbore contaminant; and, upon a positive determination to initiate the sampling of the formation fluid, signaling the formation tester 31B (e.g., via the electrical connection provided by wet latch assembly 45) to sample the formation fluid (e.g., to restrict flow from guard zone(s) into guard line(s) 76 and to introduce fluid from sample line 77 and common line 78 into the one or more sample chambers 75.

As noted hereinabove, BHA 30 can comprise one or more rechargeable batteries, such as battery B1 of formation tester section or subassembly 31B, battery B2 of processor section or subassembly 31C, and battery B3 of processor section or subassembly 31E depicted in the embodiment of FIG. 1A. A method 100 of this disclosure can further comprise recharging a battery (e.g., such as battery B1, battery B2, battery B3 of FIG. 1A) of the BHA 30 via the electrical connection provided by wet latch assembly 45.

Figure 1F:
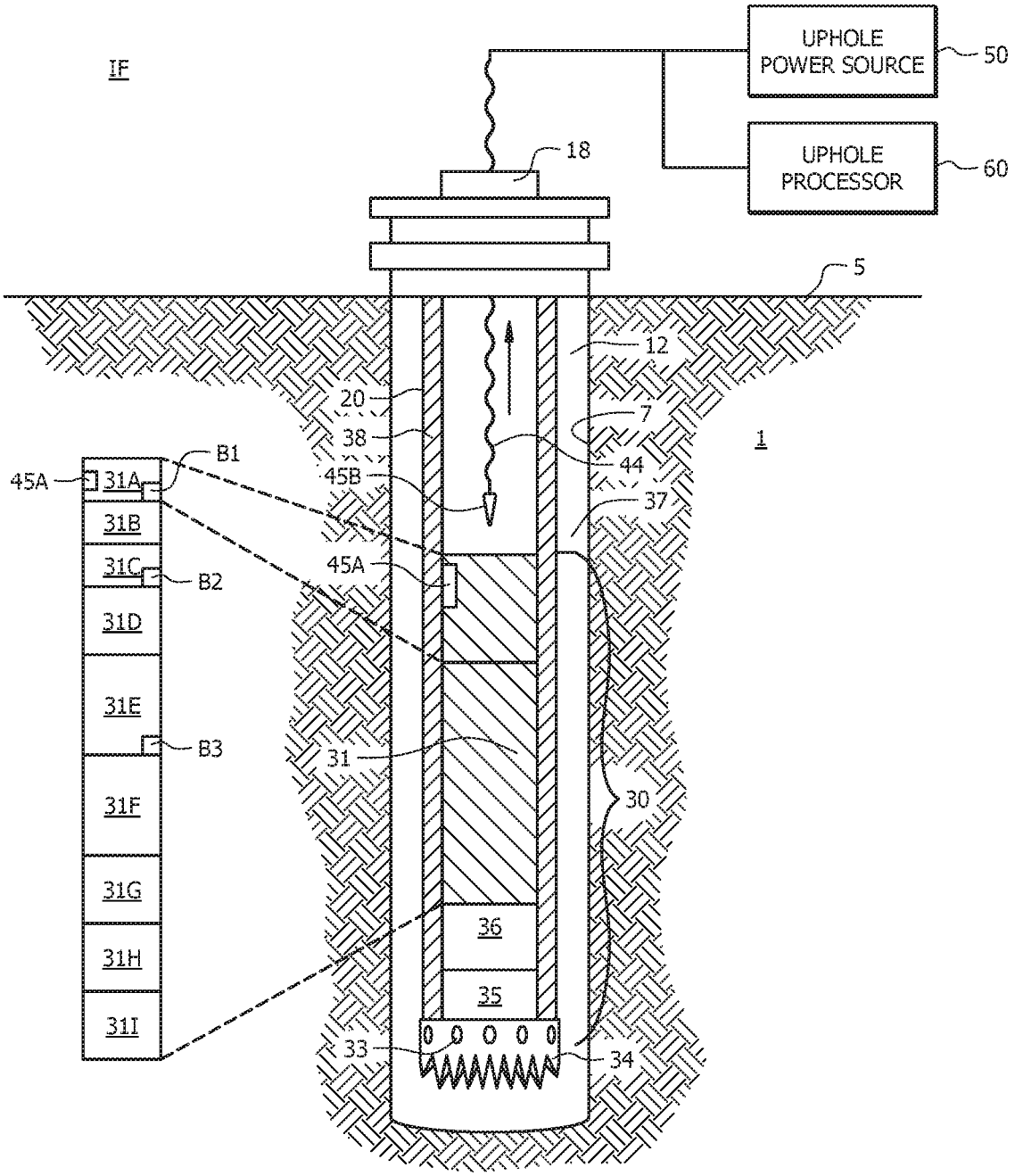

Method 100 can further comprise, subsequent testing of the formation 1 and/or telemetry of data from BHA 30 to surface 5 (e.g., to uphole processor 60) via wet latch assembly 45 and wireline cable 44 and/or recharging of one or more rechargeable batteries of BHA 30 via wet latch assembly 45, wireline cable 44, and power source 50, retrieving the wireline cable 44 and the second component 45B of the wet latch assembly 45 from the wellbore 12. As depicted in FIG. 1F, in embodiments, the first component 45A of the wet latch assembly 45 is decoupled from the second component 45B of the wet latch assembly 45, and wireline cable 44 and second component 45B are retrieved from wellbore 12 (as indicated by the arrow adjacent wireline cable 44 in FIG. 1F). In such embodiments, as depicted in FIG. 1H, first component 45A is retracted from the interior flow bore 32B of the BHA 30 subsequent the testing of the formation 1, such that the interior flow bore 32B of the BHA is once again substantially unobstructed (e.g., prior to recommencing of drilling operations and circulation of drilling fluid within wellbore 12).

Figure 1G:
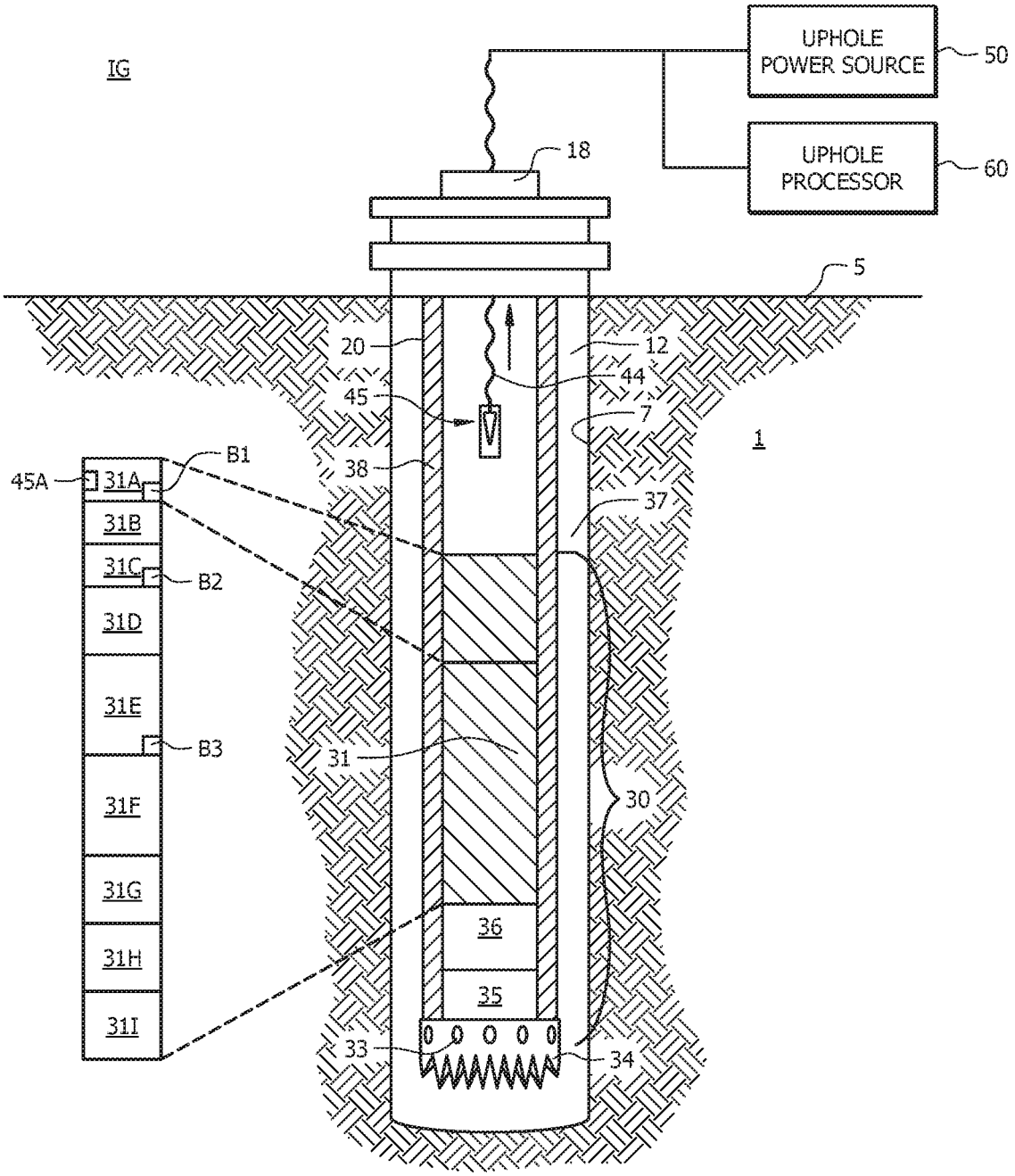
Figure 1H:
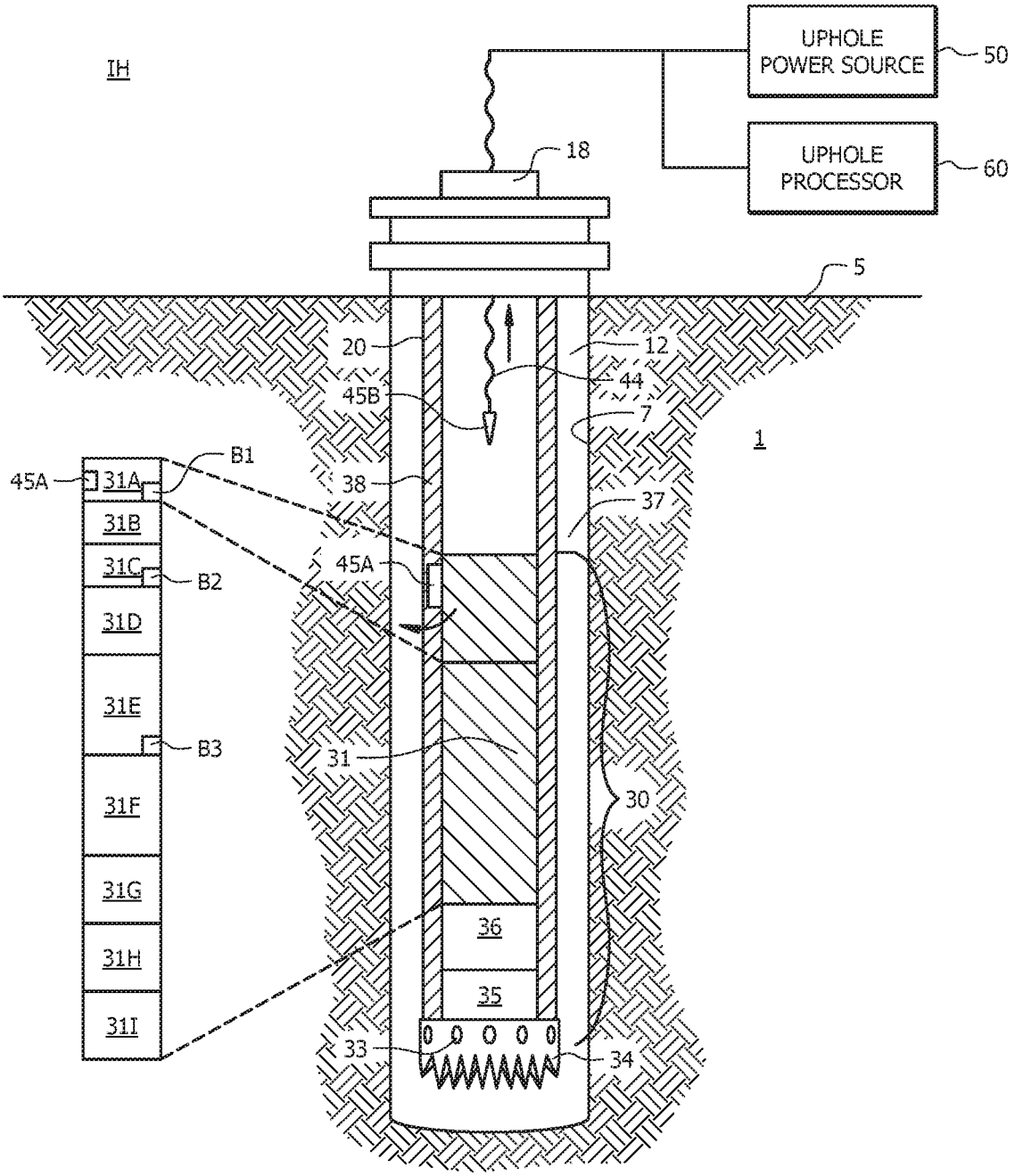

Alternatively, as depicted in FIG. 1G, in embodiments, first component 45A is designed to separate from BHA 30 and remain coupled with second component 45B during retrieval of wireline cable 44 from wellbore 12. In such embodiments, first component 45A of the wet latch assembly 45 decouples from the BHA 30, remains coupled to the second component 45B of the wet latch assembly 45, and is retrieved from the wellbore 12 with the wireline cable 44 and the second component 45B of the wet latch assembly 45, such that the interior flow bore 32B of the BHA 30 is once again substantially unobstructed (e.g., prior to recommencing of drilling operations and circulation of drilling fluid within wellbore 12).

Subsequent retrieval of wireline cable 44 from wellbore 12, method 100 can further comprise continuing drilling of the well by recommencing drilling with the drill bit 34 (e.g., rotating of drill bit 34 or cutters thereof, as indicated by the arrow below drill bit 34 in FIG. 1A) and recommencing circulation of the drilling fluid downhole through the interior flow bore 32 of the drill string 18 (as indicated by the arrow within flow bore 32 of FIG. 1A), through ports in the drill bit 33, and uphole through the annulus 37 between the drill string 18 and walls 7 of the wellbore 12 (as indicated by the arrows from ports 33 and up through annulus 37 in FIG. 1A). Upon encountering another interval of interest of formation 1, another formation test can be performed by repeating method steps 102 to 104 of method 100 of FIG. 5. Specifically, in such applications, the method of this disclosure can further comprise repeating, as described above, the discontinuing drilling of the well by ceasing the drilling with (e.g., rotating of) the drill bit 34 at step 102; the assembling, downhole, the or another wet latch assembly 45 without removing the BHA 30 from wellbore 12 at step 103, and the providing power to one or more sections or subassemblies of BHA 30 via the wet latch assembly 45 at step 104. Assembling, downhole, the or another wet latch assembly 45 without removing the BHA 30 from wellbore 12 at step 103 can comprise: without removing the BHA 30 from the wellbore 12, extending, into the interior flow bore 32B of the BHA 30 to provide an extended first component 45A, the first component 45A of the wet latch assembly 45 for a second time or another first component 45A of the wet latch assembly 45 for a first time; conveying downhole via the wireline cable 44, from the surface 5 and through the interior flow bore 32 provided by the drill string 18, the second component 45B of the wet latch assembly 45, and coupling the second component 45B of the wet latch assembly 45 with the extended first component 45A of the wet latch assembly 45 such that an electrical connection is established between the first component 45A and the second component 45B and between the BHA 30 and the surface 5 (e.g., power source 50) via the wireline cable 44. Providing power to one or more sections or subassemblies 31 of BHA 30 via the wet latch assembly 45 at step 104 can comprise testing the formation 1, as described hereinabove, with the formation tester 31B for at least a second time, wherein testing the formation 1 comprises providing power to the formation tester 31B from the surface 5 (e.g., from power source 50) via the wet latch assembly 45 and the wireline cable 44. In embodiments, this subsequent formation test is performed with a same or a different formation tester from the formation tester utilized to perform the prior formation test. For example, a first formation test powered by a first wet latch assembly 45 can be performed with a formation tester that is the same as or different from a formation tester powered by the same re-made wet latch assembly 45 (i.e., the same first component 45A and the same second component 45B) or a new wet latch assembly (e.g., a wet latch assembly 45 comprising a different first component 45A and/or a different second component 45B). For example, a first formation test powered by the wet latch assembly 45 can be performed by formation tester of section or subassembly 31B and a second formation test powered by the or another wet latch assembly 45 can be performed by formation tester 31B or a downhole tool of another section or subassembly 31 of BHA 30.

Also disclosed herein is a method of forming a BHA 30, the method comprising: coupling a first subassembly 31A of the BHA 30 comprising the first component 45A of the wet latch assembly 45 with a second subassembly 31B of the BHA 30 comprising the formation tester, such that power can be provided to the formation tester via the wet latch assembly 45 when the wet latch assembly 45 is assembled, wherein the first subassembly 31A has a first interior flow bore comprising a portion of BHA flow bore 32B and the second subassembly has a second interior flow bore comprising a portion of BHA flow bore 32B; and fluidly coupling the second subassembly 31B with the drill bit 34, whereby fluid can flow through the interior flow bore 32B of the BHA 30 comprising the interior flow bore of the first subassembly 31A and the interior flow bore of the second subassembly 31B through the drill bit 34 or vice versa. The method can further comprise coupling a third subassembly 36 comprising a rotational power generator with the drill bit 34 such that rotation of the drill bit 34 can be utilized to generate power, wherein the third subassembly 36 comprises a third interior flow bore comprising a portion of BHA flow bore 32B such that fluid can flow through the interior flow bore of the BHA 32B comprising the interior flow bore of the first subassembly 31A, the interior flow bore of the second subassembly 31B, and the interior flow bore of the third subassembly 36, through the drill bit 34 or vice versa. Such a method of forming a BHA 30 can further comprise coupling a fourth subassembly 31H into the BHA 30, wherein the fourth subassembly 31H comprises a pulse power generator operable to provide telemetry from one or more subassembly uphole (e.g., to uphole processor 60), wherein the fourth subassembly 31H comprises a fourth interior flow bore comprising a portion of BHA flow bore 32B, such that fluid can flow through the interior flow bore 32B of the BHA 30 comprising the interior flow bore of the first subassembly 31A, the interior flow bore of the second subassembly 31B, the interior flow bore of the third subassembly 36, and the interior flow bore of the fourth subassembly 31H, through the drill bit 34 or vice versa.

A method of this disclosure can comprise:

(1) as depicted in FIG. 1A, but with cessation of the rotation of drill bit 34 indicated by the arrow below drill bit 34 in FIG. 1A, discontinuing drilling, with a drill string 18, of a well comprising an uncased wellbore 12 intersecting a subsurface zone of interest below a surface 5, wherein the drill string 18 comprises a conveyance 20 and a BHA 30 coupled to the conveyance 20, wherein the BHA 30 comprises a formation tester 31B and has a downhole end comprising a drill bit 34, wherein the conveyance 20 and the BHA 30 each have an interior flow bore (32A and 32B, respectively) and together provide the drill string 18 with an interior flow bore 32 extending from the surface 5 to the drill bit 34, and wherein discontinuing the drilling comprises ceasing the drilling with (e.g., rotating of) the drill bit 34;

(2) as depicted in FIG. 1B, without removing the BHA 30 from the wellbore, 12 extending, into the interior flow bore 32B of the BHA 30, a first component 45A of a wet latch assembly 45 to provide an extended first component 45A of the wet latch assembly 45;

(3) as depicted in FIG. 1C, conveying downhole via a wireline cable 44, from the surface 5 through the interior flow bore 32 provided by the drill string 18, a second component 45B of the wet latch assembly 45, wherein the conveying comprises circulating a drilling fluid downhole through the interior flow bore 32 of the drill string 18, through ports 33 in the drill bit 34, and uphole through an annulus 37 between the drill string 18 and walls 7 of the wellbore 12;

(4) as depicted in FIG. 1D, providing an assembled wet latch assembly 45 by coupling the second component 45B of the wet latch assembly 45 with the extended first component 45A of the wet latch assembly 45 such that an electrical connection is established between the first component 45A and the second component 45B and between the BHA 30 and the surface 5 via the wireline cable 44;

(5) discontinuing circulating of the drilling fluid downhole through the interior flow bore 32 of the drill string 18, through ports 33 in the drill bit 34, and uphole through the annulus 37 between the drill string 18 and walls 7 of the wellbore 12;

(6) as depicted in FIG. 1E, supplying power to the formation tester section or subassembly 31B and/or another downhole tool section or subassembly (e.g., 31C-31I of FIG. 1A) of the BHA30 from the surface 5 (e.g., from power source 50) and/or telemetry of data between the formation tester section or subassembly 31B and/or the another downhole tool section or subassembly of the BHA 30 and the surface 5 (e.g., the uphole processor 60) via the assembled wet latch assembly 45 and the wireline cable 45;

(7) initializing a testing of the formation 1, wherein the testing of the formation 1 comprises initializing and performing a pumpout of the formation 1 and sampling the formation 1;

(8) performing the pumpout of the testing of the formation 1, wherein performing the pumpout comprises pumping formation fluid from the formation 1 for a period of time sufficient for the amount of a near wellbore contaminant present in the formation fluid to be reduced;

(9) supplying telemetry of data between the formation tester section or subassembly 31B and/or another component section or subassembly of the BHA 30 (e.g., processor section or subassembly 31C and/or processor section or subassembly 31E of BHA 30) and the surface 5 (e.g., processor 60) via the assembled wet latch assembly 45 during the pumpout;

(10) analyzing data telemetered from the formation tester 31B to the surface 5 at (9) indicative of the amount of the near wellbore contaminant present in the formation fluid to determine whether to initiate a sampling of the formation fluid and, upon a positive determination to initiate the sampling of the formation fluid, signaling the formation tester 31B (e.g., via the electrical connection provided by wet latch assembly 45) to sample the formation fluid, wherein sampling the formation fluid comprises taking a measurement of a property of the formation fluid and/or storing a sample of the formation fluid in the formation tester section or subassembly 31B (e.g., in one or more sample chambers 75 of the formation tester);

(11) optionally recharging a battery B1 of the formation tester and/or a battery (e.g., battery B2 of processor section or subassembly 31C and/or battery B3 of processor section or subassembly 31E) of another component section or subassembly 31 of the BHA 30 via the assembled wet latch assembly 45 at any time subsequent (4) and prior to (12);

(12) as depicted in FIG. 1F, subsequent the sampling of the formation fluid, (i) decoupling the second component 45B of the wet latch assembly 45 from the extended first component 45A of the wet latch assembly 45 or, as depicted in FIG. 1G: (ii) disconnecting the first component 45A of the wet latch assembly 45 from the BHA 30;

(13) as depicted in FIG. 1G and FIG. 1H, retrieving the wireline cable 44 from the wellbore 12;

(14) as depicted in FIG. 1H, retracting the first component 45A of the wet latch assembly 45 from the interior flow bore 32B of the BHA 30 if the second component 45B of the wet latch assembly 45 was decoupled from the extended first component 45A of the wet latch assembly 45 at (12)(*i*);

(15) as depicted in FIG. 1A, recommencing circulation of the drilling fluid downhole through the interior flow bore 32 of the drill string 18, through ports 33 in the drill bit 34, and uphole through the annulus 37 between the drill string 18 and walls 7 of the wellbore 12; and

(16) as further depicted in FIG. 1A, continuing drilling of the well by recommencing drilling with (e.g., rotating of) the drill bit 34.

The order of the steps can be altered or two or more steps can be performed simultaneously or in an overlapping manner. for example, retracting the first component 45A of the wet latch assembly 45 from the interior flow bore 32B of the BHA 30 at step (14) can be performed prior to, during, and/or subsequent to decoupling the second component 45B of the wet latch assembly 45 from the extended first component 45A of the wet latch assembly 45 at step (12)(i).

Those of ordinary skill in the art will readily appreciate various benefits that may be realized by the present disclosure. The system and method of this disclosure allow power to be provided downhole to a formation tester 31B via a wet latch assembly 45 that provides an electrical connection (made downhole) between a first component 45A and a second component 45B. The first component 45A can be downhole prior to assembly of the wet latch assembly 45, and either remain downhole (e.g., be retracted into formation tester section or subassembly 31B) or be retrieved from the wellbore 12 subsequent use; and the second component 45B is conveyed downhole prior to assembly of the wet latch assembly 45 and retrieved from wellbore 12 subsequent use in wet latch assembly 45. Via the wet latch assembly 45 of this disclosure, electric power can be supplied more easily and less expensively than with conventional wired pipe.

The herein disclosed system and method can utilize a retractable or retrievable first component or wet connect 45A, such that an interior flow bore of a BHA 30 can be unimpeded by the wet connect subsequent operation of the wet latch assembly 45, prior to recommencement of mud circulation and drilling operations. Multiple first components of wet connect receptacles can be utilized to provide for multi-use operation. The use of a (e.g., retractable or retrievable) first component/wet connect 45A enables a wet latch assembly 45 of this disclosure to be utilized for providing power for formation testing on LWD.

By powering a pumpout via the wet latch assembly 45 rather than via circulation of drilling fluid, a better filter cake 4 can be maintained, due to a reduced amount of active invasion during the pumpout. By eliminating a need for the circulation of mud, which erodes the filter cake along the well bore, and can inhibit or prevent the filter cake from building to a sufficient thickness and can also can inhibit or prevent the curing of the filter cake, less leakage (e.g., a lower leakage rate) of mud filtrate into the formation from the filter cake is experienced relative to leakage experienced during drilling fluid circulation. Minimization of this active invasion can enable the acquisition of low contamination samples during the pumpout process of a formation testing, because a lower steady state contamination level is present. Accordingly, the system and method of this disclosure may provide for obtaining cleaner formation samples in a shorter period of time (e.g., a shorter pumpout time), optionally with the added advantages of providing telemetry to surface 5 (e.g., to uphole processor 60) during pumpout and potentially downloading information from memory on the BHA 30, and/or recharging battery components. The telemetry provided by the system and method of this disclosure can be superior to conventional pressure pulse (e.g., mud pulse) telemetry, which typically provides less than 10 bits per second. For example, the telemetry provided via the system and method of this disclosure can provide for data transmission at greater than or equal to about 1, 2, 3, 4, or 5 MB/s.

As will be known to those of skill in the art, at the end of a formation pumpout, a pressure wave or buildup produced by the formation fluid can be utilized to obtain information pertaining to an extent of the reservoir. By performing a pumpout via the herein disclosed system and method, without utilizing drilling fluid circulation for power production during formation testing (and pumpout), a better pressure measurement (e.g., a mini drill stem test (DST)) can be obtained due to the lack of the noise that is generally present due to the circulation of the drilling fluid. In embodiments, some amount of power required by BHA 30 is produced downhole and another amount is produced uphole and provided downhole via the wet latch assembly 45.

The system and method of this disclosure may further provide an advantage of better depth control on the wire line string 44, since the inner pipe tension would likely be more evenly distributed.

Additional Disclosure

The following are non-limiting, specific embodiments in accordance with the present disclosure:

Embodiment A: A method comprising: without removing a BHA from a wellbore of a well extending into a formation, extending, into an interior flow bore of the BHA, a first component of a wet latch assembly to provide an extended first component of the wet latch assembly; conveying downhole via a wireline cable, from a surface through an interior flow bore provided by a drill string, a second component of the wet latch assembly, and coupling the second component of the wet latch assembly with the extended first component of the wet latch assembly such that an electrical connection is established between the first component and the second component and between the BHA and the surface via the wireline cable; and testing the formation with a formation tester of the BHA, wherein testing the formation comprises providing power and/or data telemetry for the formation tester via the wet latch assembly and the wireline cable.

Embodiment B: The method of claim 1 further comprising drilling, with a drill bit on a downhole end of the drill string, the wellbore, wherein the drill string comprises a conveyance coupled to the BHA whereby the conveyance and the BHA each have an interior flow bore and together provide the drill string with the interior flow bore provided by the drill string, and wherein the drilling comprises drilling while circulating a drilling fluid through the interior flow bore of the drill string, through ports in the drill bit, and through an annulus between the drill string and walls of the wellbore; and discontinuing drilling of the well by ceasing drilling with the drill bit.

Embodiment C: The method of Embodiment A or Embodiment B, wherein extending the first component is responsive to a signal received by the BHA from the surface.

Embodiment D: The method of any of Embodiment A to Embodiment C, wherein the second component is conveyed downhole through the interior flow bore provided by the drill string via circulation of the drilling fluid.

Embodiment E: The method of Embodiment D wherein the drilling fluid is circulated downhole at a first rate during the drilling, wherein the drilling fluid is circulated downhole at a second rate during the conveying downhole of the second component, and wherein the second rate is less than the first rate.

Embodiment F: The method of Embodiment D or Embodiment E further comprising, upon establishing the electrical connection, discontinuing circulation of the drilling fluid.

Embodiment G: The method of any of Embodiment A to Embodiment F, wherein the formation tester comprises a logging while drilling (LWD) tool and/or a measurement while drilling (MWD) tool.

Embodiment H: The method of any of Embodiment A to Embodiment G, wherein testing the formation comprises contacting a wellbore wall of the wellbore with a sampling probe of the formation tester and pumping formation fluid from the formation through the wellbore wall and probe into the formation tester.

Embodiment I: The method of Embodiment H, wherein the testing the formation further comprises determining an amount of a near wellbore contaminant present in the formation fluid.

Embodiment J: The method of Embodiment I, wherein the testing the formation further comprises pumping formation fluid from the formation for a pumpout period of time sufficient for the amount of the near wellbore contaminant present in the formation fluid to be reduced.

Embodiment K: The method of Embodiment J further comprising performing a drill stem test (DST) via the BHA subsequent the pumpout period of time.

Embodiment L: The method of any of Embodiment A to Embodiment K, wherein testing the formation comprises sampling the formation fluid and/or storing a sample of the formation fluid in the formation tester.

Embodiment M: The method of any of Embodiment I to Embodiment L, wherein the drilling fluid is an oil based drilling fluid and the near wellbore contaminant is an oleaginous filtrate from the drilling fluid during deposition of a filter cake on the walls of the wellbore by the oil based drilling fluid.

Embodiment N: The method of any of Embodiment A to Embodiment M, comprising supplying data telemetry from the formation tester and/or from another component of the BHA to the surface.

Embodiment O: The method of any of Embodiment I to Embodiment N further comprising supplying data telemetry from the formation tester to the surface, wherein the data telemetry is indicative of the amount of the near wellbore contaminant present in the formation fluid.

Embodiment P: The method of Embodiment O further comprising: analyzing, at the surface, the data telemetry to determine at least in part an amount of the near wellbore contaminant present in the formation fluid and whether to initiate the sampling of the formation fluid based at least in part upon the amount of the near wellbore contaminant; and upon a positive determination to initiate the sampling of the formation fluid, signaling the formation tester to sample the formation fluid.

Embodiment Q: The method of any of Embodiment A to Embodiment P further comprising recharging a battery of the BHA via the electrical connection.

Embodiment R: The method of any of Embodiment A to Embodiment Q further comprising: subsequent the testing the formation, retrieving the wireline cable and the second component of the wet latch assembly from the wellbore.

Embodiment S: The method of Embodiment R: wherein the first component of the wet latch assembly is retracted from the interior flow bore of the BHA subsequent the testing of the formation, such that the interior flow bore of the BHA is substantially unobstructed; or wherein the first component of the wet latch assembly decouples from the BHA, remains coupled to the second component of the wet latch assembly, and is retrieved from the wellbore with the wireline cable and the second component of the wet latch assembly, such that the interior flow bore of the BHA is substantially unobstructed.

Embodiment T: The method of any of Embodiment B to Embodiment S further comprising: continuing drilling of the well by recommencing drilling with the drill bit and recommencing circulation of the drilling fluid downhole through the interior flow bore of the drill string, through ports in the drill bit, and uphole through the annulus between the drill string and walls of the wellbore.

Embodiment U: The method of Embodiment T further comprising: discontinuing drilling of the well by ceasing the drilling with the drill bit; without removing the BHA from the wellbore, extending, into the interior flow bore of the BHA to provide an extended first component, the first component of the wet latch assembly for a second time or another first component of the wet latch assembly for a first time; conveying downhole via the wireline cable, from the surface through the interior flow bore provided by the drill string, the second component of the wet latch assembly, and coupling the second component of the wet latch assembly with the extended first component of the wet latch assembly such that an electrical connection is established between the first component and the second component and between the BHA and the surface via the wireline cable; and testing the formation with the formation tester for at least a second time, wherein testing the formation comprises providing power to the formation tester from the surface via the wet latch assembly and the wireline cable.

Embodiment V: A method comprising: (1) discontinuing drilling, with a drill string, of a well comprising an uncased wellbore intersecting a subsurface zone of interest below a surface, wherein the drill string comprises a conveyance and a bottom hole assembly (BHA) coupled to the conveyance, wherein the BHA comprises a formation tester and has a downhole end comprising a drill bit, wherein the conveyance and the BHA each have an interior flow bore and together provide the drill string with an interior flow bore extending from the surface to the drill bit, and wherein discontinuing the drilling comprises ceasing the drilling with the drill bit; (2) without removing the BHA from the wellbore, extending, into the interior flow bore of the BHA, a first component of a wet latch assembly to provide an extended first component of the wet latch assembly; (3) conveying downhole via a wireline cable, from the surface through the interior flow bore provided by the drill string, a second component of the wet latch assembly, wherein the conveying comprises circulating a drilling fluid downhole through the interior flow bore of the drill string, through ports in the drill bit, and uphole through an annulus between the drill string and walls of the wellbore; (4) providing an assembled wet latch assembly by coupling the second component of the wet latch assembly with the extended first component of the wet latch assembly such that an electrical connection is established between the first component and the second component and between the BHA and the surface via the wireline cable; (5) discontinuing circulating of the drilling fluid downhole through the interior flow bore of the drill string, through ports in the drill bit, and uphole through the annulus between the drill string and walls of the wellbore; (6) supplying power to the formation tester and/or another component of the BHA from the surface and/or telemetry of data between the formation tester and/or the another component of the BHA and the surface via the assembled wet latch assembly and the wireline cable; (7) initializing a testing of the formation, wherein the testing of the formation comprises performing a pumpout of the formation and sampling the formation; (8) performing the pumpout of the testing of the formation, wherein performing the pumpout comprises pumping formation fluid from the formation for a period of time sufficient for the amount of a near wellbore contaminant present in the formation fluid to be reduced; (9) supplying telemetry of data between the formation tester and/or another component of the BHA and the surface via the assembled wet latch assembly during the pumpout; (10) analyzing data telemetered from the formation tester to the surface at (9) indicative of the amount of the near wellbore contaminant present in the formation fluid to determine whether to initiate a sampling of the formation fluid and, upon a positive determination to initiate the sampling of the formation fluid, signaling the formation tester to sample the formation fluid, wherein sampling the formation fluid comprises taking a measurement of a property of the formation fluid and/or storing a sample of the formation fluid in the formation tester; (11) optionally recharging a battery of the formation tester and/or a battery of another component of the BHA via the assembled wet latch assembly at any time subsequent (4) and prior to (12); (12) subsequent the sampling of the formation fluid, (i) decoupling the second component of the wet latch assembly from the extended first component of the wet latch assembly or (ii) disconnecting the first component of the wet latch assembly from the BHA; (13) retrieving the wireline cable from the wellbore; (14) retracting the first component of the wet latch assembly from the interior flow bore of the BHA if the second component of the wet latch assembly was decoupled from the extended first component of the wet latch assembly at (12)(i); (15) recommencing circulation of the drilling fluid downhole through the interior flow bore of the drill string, through ports in the drill bit, and uphole through the annulus between the drill string and walls of the wellbore; and (16) continuing drilling of the well by recommencing drilling with the drill bit.

Embodiment W: A bottom hole assembly (BHA) comprising: a first component of a wet latch assembly, the first component configured for coupling, when extended into the interior flow bore of the BHA, with a second component of the wet latch assembly to provide an assembled wet latch assembly, such that an electrical connection can be made between the first component and the second component; and a formation tester operable for performing a formation test, the formation tester electrically connected with the first component of the wet latch assembly, such that power and/or telemetry can be provided to the formation tester via the assembled wet latch assembly during the formation test.

Embodiment X: The BHA of Embodiment W further comprising a battery, wherein the battery is electrically connected with the first component of the wet latch assembly, such that power can be provided to the battery via the assembled wet latch assembly.

Embodiment Y: The BHA of Embodiment W or Embodiment X, wherein the formation tester and/or another component of the BHA is electrically connected with the first component of the wet latch assembly, such that telemetry of data can be provided from the formation tester and/or the another component of the BHA uphole via the assembled wet latch assembly.

Embodiment Z1: The BHA of any of Embodiment W to Embodiment Y, wherein the first component of the wet latch assembly is located in a first subassembly of the BHA, wherein the first subassembly of the BHA is distal a drill bit located on a downhole end of the BHA.

Embodiment Z2: The BHA of any of Embodiment W to Embodiment Z1, wherein the first component is retractable back out of the interior flow bore of the BHA subsequent extension of the first component into the interior flow bore during the performing of the formation test and/or wherein the first component is designed for breakaway from the BHA subsequent the performing of the formation test.

Embodiment Z3: The BHA of any of Embodiment W to Embodiment Z2 comprising multiple first components.

Embodiment Z4: The BHA of Embodiment Z3, wherein the multiple first components of the wet latch assembly are positioned about an interior circumference of the interior flow bore of the BHA.

Embodiment Z5: The BHA of any of Embodiment W to Embodiment Z4, wherein the first component comprises a first contact component comprising a plug having one or more pins configured for coupling with a second contact component of the second component, wherein the second contact component comprises a complementary jack having one or more holes configured to accept the one or more pins of the plug.

Embodiment Z6: The BHA of any of Embodiment W to Embodiment Z5, wherein the formation tester further comprises a sampling probe, wherein the sampling probe is configured for contacting the wellbore wall during pumping of formation fluid from the formation through the wellbore wall and the sampling probe into the formation tester during the performing of the formation test.

Embodiment Z7: A system comprising: a drill string comprising a conveyance coupled to the BHA of any of Embodiment V to Embodiment Z5, wherein the conveyance also comprises an interior flow bore, such that the flow bore extends from the surface to a drill bit on a downhole end of the BHA, whereby, during drilling, a drilling fluid can be circulated downhole through the interior flow bore of the drill string, through ports in the drill bit, and uphole through an annulus between the drill string and walls of the wellbore; the second component of the wet latch assembly, wherein the second component of the wet latch assembly is coupled with the first component of the wet latch assembly such that the electrical connection is made between the first component and the second component, and wherein the second component is attached to a logging cable, wherein the logging cable extends to a surface from which the drill string extends.

Embodiment Z8: The system of Embodiment Z7, wherein the drill string further comprises drill pipe or coiled tubing.

Embodiment Z9: The system of Embodiment Z8, wherein the first component of the wet latch assembly is located in a first subassembly of the BHA, wherein the first subassembly of the BHA is threadably connected with a last section of the drill pipe or coiled tubing, wherein the last section of drill pipe or coiled tubing is a section of coiled tubing or drill pipe extending farthest into the wellbore.

Embodiment Z10: The system of any of Embodiment Z7 to Embodiment Z9, wherein the first component comprises a first contact component comprising a plug having one or more pins.

Embodiment Z11: The system of Embodiment Z10, wherein the second component comprises a second contact component including a complementary jack having one or more holes configured to accept the one or more pins of the plug.

Embodiment Z12: The system of Embodiment Z11, wherein the first component and/or the second component comprises a rubber and/or fluid filled housing, such that the first contact component of the first component, the second contact component of the second component, or both can be wiped clean during coupling and de-coupling of the first component and the second component.

Embodiment Z13: The system of any of Embodiment Z7 to Embodiment Z12, wherein the second component is asymmetric or otherwise designed to facilitate coupling of the first component with the second component.

Embodiment Z14: The system of any of Embodiment Z7 to Embodiment Z13, wherein the first component is spring loaded for extension into the interior flow bore of the BHA or for retraction from the interior flow bore of the BHA.

Embodiment Z15: A method of forming a BHA of any of Embodiment W to Embodiment Z6, the method comprising: coupling a first subassembly of the BHA comprising the first component of the wet latch assembly with a second subassembly of the BHA comprising the formation tester, such that power and/or telemetry can be provided to the formation tester via the wet latch assembly when the wet latch assembly is assembled, wherein the first subassembly has a first interior flow bore and the second subassembly has a second interior flow bore.

Embodiment Z16: The method of Embodiment Z15 further comprising: fluidly coupling the second subassembly with a drill bit on a downhole end of the BHA, whereby fluid can flow through the interior flow bore of the BHA comprising the interior flow bore of the first subassembly and the interior flow bore of the second subassembly through the drill bit or vice versa; and coupling a third subassembly comprising a rotational power generator with the drill bit such that rotation of the drill bit can be utilized to generate power, wherein the third subassembly comprises a third interior flow bore such that fluid can flow through the interior flow bore of the BHA comprising the interior flow bore of the first subassembly, the interior flow bore of the second subassembly, and the interior of the third subassembly, through the drill bit or vice versa.

Embodiment Z17: The method of Embodiment Z16 further comprising coupling a fourth subassembly into the BHA, wherein the fourth subassembly comprises a pulse power generator operable to provide telemetry from one or more subassembly uphole, wherein the fourth subassembly comprises a fourth interior flow bore, such that fluid can flow through the interior flow bore of the BHA comprising the interior flow bore of the first subassembly, the interior flow bore of the second subassembly, the interior flow bore of the third subassembly, and the interior flow bore of the fourth subassembly, through the drill bit or vice versa.

Embodiment Z18: A method comprising: drilling, with a drill string, a well comprising an uncased wellbore intersecting a subsurface zone of interest below a surface, wherein the drill string comprises a conveyance and a bottom hole assembly (BHA) of any of Embodiment V to Embodiment Z5 coupled to the conveyance, wherein the conveyance and the BHA each have an interior flow bore and together provide the drill string with an interior flow bore extending from the surface to the drill bit, and wherein the drilling comprises drilling with the drill bit while circulating a drilling fluid downhole through the interior flow bore of the drill string, through ports in the drill bit, and uphole through an annulus between the drill string and walls of the wellbore; discontinuing drilling of the well by ceasing the drilling with the drill bit; without removing the BHA from the wellbore, extending, into the interior flow bore of the BHA, the first component of a wet latch assembly to provide an extended first component of the wet latch assembly; conveying downhole via a wireline cable, from the surface through the interior flow bore provided by the drill string, the second component of the wet latch assembly, and forming the assembled wet latch assembly by coupling the second component of the wet latch assembly with the extended first component of the wet latch assembly such that the electrical connection is established between the first component and the second component and between the BHA and the surface via the wireline cable; and testing the formation with the formation tester, wherein testing the formation comprises providing power and/or telemetry to the formation tester from the surface via the assembled wet latch assembly and the wireline cable.

Embodiment Z19: A method comprising: (1) discontinuing drilling, with a drill string, of a well comprising an uncased wellbore intersecting a subsurface zone of interest below a surface, wherein the drill string comprises a conveyance and a bottom hole assembly (BHA) of any of Embodiment V to Embodiment Z5 coupled to the conveyance, wherein the conveyance and the BHA each have an interior flow bore and together provide the drill string with an interior flow bore extending from the surface to the drill bit, and wherein discontinuing the drilling comprises ceasing the drilling with the drill bit; (2) without removing the BHA from the wellbore, extending, into the interior flow bore of the BHA, the first component of the wet latch assembly to provide an extended first component of the wet latch assembly; (3) conveying downhole via a wireline cable, from the surface through the interior flow bore provided by the drill string, the second component of the wet latch assembly, wherein the conveying comprises circulating a drilling fluid downhole through the interior flow bore of the drill string, through ports in the drill bit, and uphole through an annulus between the drill string and walls of the wellbore; (4) providing an assembled wet latch assembly by coupling the second component of the wet latch assembly with the extended first component of the wet latch assembly such that the electrical connection is established between the first component and the second component and between the BHA and the surface via the wireline cable; (5) discontinuing circulating of the drilling fluid downhole through the interior flow bore of the drill string, through ports in the drill bit, and uphole through the annulus between the drill string and walls of the wellbore; (6) supplying power to the formation tester and/or another component of the BHA from the surface and/or telemetry of data between the formation tester and/or another component of the BHA and the surface via the assembled wet latch assembly and the wireline cable; (7) initializing a testing of the formation, wherein the testing of the formation comprises performing a pumpout of the formation and sampling the formation; (8) performing the pumpout of the testing of the formation, wherein performing the pumpout comprises pumping formation fluid from the formation for a period of time sufficient for the amount of a near wellbore contaminant present in the formation fluid to be reduced; (9) optionally supplying telemetry of data between the formation tester and/or another component of the BHA and the surface via the assembled wet latch assembly during the pumpout; (10) analyzing data telemetered from the formation tester to the surface at (9) indicative of the amount of the near wellbore contaminant present in the formation fluid.to determine whether to initiate a sampling of the formation fluid and, upon a positive determination to initiate the sampling of the formation fluid, signaling the formation tester to sample the formation fluid, wherein sampling the formation fluid comprises taking a measurement of a property of the formation fluid with the formation tester and/or storing a sample of the formation fluid in the formation tester; (11) optionally recharging a battery of the formation tester and/or a battery of another component of the BHA via the assembled wet latch assembly at any time subsequent (4) and prior to (12); (12) subsequent the sampling of the formation fluid, (i) decoupling the second component of the wet latch assembly from the extended first component of the wet latch assembly or (ii) disconnecting the first component of the wet latch assembly from the BHA; (13) retrieving the wireline cable from the wellbore; (14) retracting the first component of the wet latch assembly from the interior flow bore of the BHA if the second component of the wet latch assembly was decoupled from the extended first component of the wet latch assembly at (12)(*i*); (15) recommencing circulation of the drilling fluid downhole through the interior flow bore of the drill string, through ports in the drill bit, and uphole through the annulus between the drill string and walls of the wellbore; and (16) continuing drilling of the well by recommencing drilling with the drill bit.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method comprising:

without removing a BHA from a wellbore of a well extending into a formation, extending, from a retracted position and into an interior flow bore of the BHA, a first component of a wet latch assembly to provide an extended first component of the wet latch assembly, wherein in the retracted position the second component of the wet latch assembly does not substantially obstruct the interior flow bore of the BHA;

conveying downhole via a wireline cable, from a surface through an interior flow bore provided by a drill string, a second component of the wet latch assembly, and coupling the second component of the wet latch assembly with the extended first component of the wet latch assembly such that an electrical connection is established between the first component and the second component and between the BHA and the surface via the wireline cable; and testing the formation with a formation tester of the BHA, wherein testing the formation comprises providing power and/or data telemetry for the formation tester via the wet latch assembly and the wireline cable.

2. The method of claim 1 further comprising drilling, with a drill bit on a downhole end of the drill string, the wellbore, wherein the drill string comprises a conveyance coupled to the BHA whereby the conveyance and the BHA each have an interior flow bore and together provide the drill string with the interior flow bore provided by the drill string, and wherein the drilling comprises drilling while circulating a drilling fluid through the interior flow bore of the drill string, through ports in the drill bit, and through an annulus between the drill string and walls of the wellbore; and discontinuing drilling of the well by ceasing drilling with the drill bit.

3. The method of claim 2 further comprising:

continuing drilling of the well by recommencing drilling with the drill bit and recommencing circulation of the drilling fluid downhole through the interior flow bore of the drill string, through ports in the drill bit, and uphole through the annulus between the drill string and walls of the wellbore;

discontinuing drilling of the well by ceasing the drilling with the drill bit;

without removing the BHA from the wellbore, extending, into the interior flow bore of the BHA to provide an extended first component, the first component of the wet latch assembly for a second time or another first component of the wet latch assembly for a first time;

conveying downhole via the wireline cable, from the surface through the interior flow bore provided by the drill string, the second component of the wet latch assembly, and coupling the second component of the wet latch assembly with the extended first component of the wet latch assembly such that an electrical connection is established between the first component and the second component and between the BHA and the surface via the wireline cable; and testing the formation with the formation tester for at least a second time, wherein testing the formation comprises providing power to the formation tester from the surface via the wet latch assembly and the wireline cable.

4. The method of claim 1, wherein extending the first component is responsive to a signal received by the BHA from the surface or a proximity sensor.

5. The method of claim 1, wherein the second component is conveyed downhole through the interior flow bore provided by the drill string via circulation of the drilling fluid.

6. The method of claim 5, wherein the drilling fluid is circulated downhole at a first rate during the drilling, wherein the drilling fluid is circulated downhole at a second rate during the conveying downhole of the second component, and wherein the second rate is less than the first rate.

7. The method of claim 5 further comprising, upon establishing the electrical connection, discontinuing circulation of the drilling fluid.

8. The method of claim 1, wherein the formation tester comprises a logging while drilling (LWD) tool and/or a measurement while drilling (MWD) tool.

9. The method of claim 1, wherein testing the formation comprises contacting a wellbore wall with a sampling probe of the formation tester and pumping formation fluid from the formation through the wellbore wall and probe into the formation tester.

10. The method of claim 9, wherein the testing the formation further comprises determining an amount of a near wellbore contaminant present in the formation fluid.

11. The method of claim 10, wherein the drilling fluid is an oil based drilling fluid and the near wellbore contaminant is an oleaginous filtrate from the drilling fluid during deposition of a filter cake on the walls of the wellbore by the oil based drilling fluid.

12. The method of claim 10, wherein the testing the formation further comprises pumping formation fluid from the formation for a pumpout period of time sufficient for the amount of the near wellbore contaminant present in the formation fluid to be reduced.

13. The method of claim 12 further comprising performing a drill stem test (DST) via the BHA subsequent the pumpout period of time.

14. The method of claim 10 further comprising supplying data telemetry from the formation tester to the surface, wherein the data telemetry is indicative of the amount of the near wellbore contaminant present in the formation fluid.

15. The method of claim 14 further comprising:

analyzing, at the surface, the data telemetry to determine at least in part an amount of the near wellbore contaminant present in the formation fluid and whether to initiate the sampling of the formation fluid based at least in part upon the amount of the near wellbore contaminant; and upon a positive determination to initiate the sampling of the formation fluid, signaling the formation tester to sample the formation fluid.

16. The method of claim 1, wherein testing the formation comprises sampling the formation fluid and/or storing a sample of the formation fluid in the formation tester.

17. The method of claim 1 comprising supplying data telemetry from the formation tester and/or from another component of the BHA to the surface.

18. The method of claim 1 further comprising recharging a battery of the BHA via the electrical connection.

19. The method of claim 1 further comprising:

subsequent the testing the formation, retrieving the wireline cable and the second component of the wet latch assembly from the wellbore.

20. A method comprising:

without removing a BHA from a wellbore of a well extending into a formation, extending, into an interior flow bore of the BHA, a first component of a wet latch assembly to provide an extended first component of the wet latch assembly;

conveying downhole via a wireline cable, from a surface through an interior flow bore provided by a drill string, a second component of the wet latch assembly, and coupling the second component of the wet latch assembly with the extended first component of the wet latch assembly such that an electrical connection is established between the first component and the second component and between the BHA and the surface via the wireline cable;

testing the formation with a formation tester of the BHA, wherein testing the formation comprises providing power and/or data telemetry for the formation tester via the wet latch assembly and the wireline cable; and subsequent the testing the formation: retrieving the wireline cable and the second component of the wet latch assembly from the wellbore, wherein the first component of the wet latch assembly decouples from the BHA, remains coupled to the second component of the wet latch assembly, and is retrieved from the wellbore with the wireline cable and the second component of the wet latch assembly, such that the interior flow bore of the BHA is substantially unobstructed.

21. A method comprising:

without removing a BHA from a wellbore of a well extending into a formation, extending, into an interior flow bore of the BHA, a first component of a wet latch assembly to provide an extended first component of the wet latch assembly;

conveying downhole via a wireline cable, from a surface through an interior flow bore provided by a drill string, a second component of the wet latch assembly, and coupling the second component of the wet latch assembly with the extended first component of the wet latch assembly such that an electrical connection is established between the first component and the second component and between the BHA and the surface via the wireline cable;

testing the formation with a formation tester of the BHA, wherein testing the formation comprises providing power and/or data telemetry for the formation tester via the wet latch assembly and the wireline cable; and subsequent the testing the formation: retrieving the wireline cable and the second component of the wet latch assembly from the wellbore, and retracting the first component of the wet latch assembly from the interior flow bore of the BHA such that the interior flow bore of the BHA is substantially unobstructed.

* * * * *